US011351560B2

(12) United States Patent
Takeuchi et al.

(10) Patent No.: US 11,351,560 B2
(45) Date of Patent: Jun. 7, 2022

(54) FOAM DISCHARGER

(71) Applicant: Kao Corporation, Tokyo (JP)

(72) Inventors: Masaki Takeuchi, Yoshikawa (JP); Noboru Yashima, Bunkyo-ku (JP); Yoshinori Inagawa, Chiba (JP); Shinji Oguri, Kinokawa (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 17/260,863

(22) PCT Filed: Jun. 5, 2019

(86) PCT No.: PCT/JP2019/022344
§ 371 (c)(1),
(2) Date: Jan. 15, 2021

(87) PCT Pub. No.: WO2020/017174
PCT Pub. Date: Jan. 23, 2020

(65) Prior Publication Data

US 2021/0268525 A1 Sep. 2, 2021

(30) Foreign Application Priority Data

Jul. 18, 2018 (JP) ..... JP2018-134827
Nov. 19, 2018 (JP) ..... JP2018-216243

(51) Int. Cl.
*B05B 7/00* (2006.01)
*B05B 11/00* (2006.01)

(52) U.S. Cl.
CPC ..... *B05B 7/0037* (2013.01); *B05B 11/3087* (2013.01)

(58) Field of Classification Search
CPC . B05B 7/0037; B05B 11/3087; B05B 7/0018; B05B 7/0062; A47K 5/16; A47K 5/15; A47K 5/205; B01F 23/23
(Continued)

(56) References Cited

U.S. PATENT DOCUMENTS 4,925,109 A 5/1990 Flanagan et al.
4,932,567 A * 6/1990 Tanabe ..... B05B 7/0062 222/190
(Continued)

FOREIGN PATENT DOCUMENTS

CA 1090748 A 12/1980
CA 2916666 A1 * 1/2015
(Continued)

OTHER PUBLICATIONS

International Search Report dated Aug. 27, 2019 in PCT/JP2019/022344 filed on Jun. 5, 2019, 2 pages.
(Continued)

*Primary Examiner* — Lien M Ngo
(74) *Attorney, Agent, or Firm* — Oblon, McClelland, Maier & Neustadt, L.L.P.

(57) ABSTRACT

Provided is a foam discharger including: a mixing portion for mixing a liquid agent and a gas to foam the liquid agent; a discharge opening for discharging the foamed liquid agent; and a flow path in communication with the discharge opening, and for supplying the foamed liquid agent from the mixing portion to the discharge opening. The discharge opening is provided with a first porous member. On an upstream side of the first porous member, a cross-sectional area of the flow path on a cross section orthogonal to a supply direction in which the foamed liquid agent is to be supplied increases along the supply direction. The cross-sectional area of the flow path at the discharge opening is at least 1.2 times the minimum cross-sectional area of the flow path.

20 Claims, 18 Drawing Sheets

(58) Field of Classification Search
USPC ..... 222/190, 321.1, 321.7, 321.9, 145, 5
See application file for complete search history.

(56) References Cited

U.S. PATENT DOCUMENTS

| | | | | |
|---|---|---|---|---|
| 9,427,118 | B2 * | 8/2016 | Brouwer | B05B 11/3001 |
| 9,868,128 | B2 * | 1/2018 | Tepas | B05B 11/3001 |
| 2002/0056730 | A1 * | 5/2002 | van de Heijden | B05B 11/0005 222/190 |
| 2005/0115988 | A1 * | 6/2005 | Law | B05B 11/3087 222/145.5 |
| 2006/0219738 | A1 | 10/2006 | Iizuka et al. | |
| 2007/0040048 | A1 * | 2/2007 | Poizot | B05B 7/0037 239/343 |
| 2010/0126523 | A1 * | 5/2010 | Fujinuma | B05B 11/048 132/221 |
| 2011/0272488 | A1 * | 11/2011 | Baughman | B05B 11/3016 239/311 |
| 2011/0284586 | A1 * | 11/2011 | Kerr | A45D 19/02 222/190 |
| 2013/0068794 | A1 | 3/2013 | Kodama et al. | |
| 2015/0136807 | A1 * | 5/2015 | Wang | B05B 11/3023 222/190 |
| 2020/0316619 | A1 | 10/2020 | Uchiyama et al. | |

FOREIGN PATENT DOCUMENTS

| | | | |
|---|---|---|---|
| CN | 102822069 | A | 12/2012 |
| CN | 107107078 | A | 8/2017 |
| CN | 108025843 | A | 5/2018 |
| JP | H07-215353 | A | 8/1995 |
| JP | 7-315401 | A | 12/1995 |
| JP | 2005319394 | A | 11/2005 |
| JP | 2011-251691 | A | 12/2011 |
| JP | 2012-110799 | A | 6/2012 |
| JP | 2018-8746 | A | 1/2018 |
| JP | 2018-52601 | A | 4/2018 |
| JP | 2018-083637 | A | 5/2018 |
| WO | 2005/056415 | A1 | 6/2005 |
| WO | WO 2013/118816 | A1 * | 8/2013 |

OTHER PUBLICATIONS

Xiao, Yue, "Recent Developments in Hand Soap in Japan", China Detergent Issue 5, p. 46-48, (2009) (with English translation).

* cited by examiner

| | Example 1 | Example 2 | Example 3 | Example 4 | Example 5 |
|---|---|---|---|---|---|
| Cross-sectional area ratio | | 1.2 times | 1.9 times | 2.6 times | 1.2 times |
| L(mm) | 25.6mm | 5mm | 5mm | 5mm | 3mm |
| Foam quality image |  |  |  |  |  |

| | Comparative Example 1 | Comparative Example 2 |
|---|---|---|
| Cross-sectional area ratio | 0.5 times | 0.8 times |
| L(mm) | 5mm | 5mm |
| Foam quality image |  |  |

FOAM DISCHARGER

TECHNICAL FIELD

The present invention relates to a foam discharger.

BACKGROUND ART

Examples of foam dischargers configured to discharge a liquid agent in a foamed state include discharging containers (foam dischargers) disclosed in Patent Literatures 1 to 5. The discharging container of Patent Literature 1 is capable of mixing a liquid agent and a gas to produce a foamed liquid agent, and discharging the foamed liquid agent (foam) to outside the discharging container. The discharging container disclosed in Patent Literature 1 includes a porous element provided to a discharge opening, and makes the foamed liquid agent pass through the porous element, to thereby discharge a foamed liquid agent with uniform and fine foam structure. Patent Literature 2 discloses a foam producing device (foam discharger) that produces a foamed liquid agent by: spraying a liquid agent into a space provided near a discharge opening and thereby mixing the liquid agent and air in this space; and making the mixture pass through a porous element provided to the discharge opening. Patent Literatures 3 to 5 disclose foam-discharging containers capable of mixing a liquid agent and a gas to produce a foamed liquid agent, and discharging the foamed liquid agent to outside the respective foam-discharging container.

CITATION LIST

Patent Literature

Patent Literature 1: JP2018-052601(A)
Patent Literature 2: CA1090748(A)
Patent Literature 3: JP2011-251691(A)
Patent Literature 4: US2006219738(A1)
Patent Literature 5: GB2566203(A)

SUMMARY OF INVENTION

The invention relates to a foam discharger including: a mixing portion configured to mix a liquid agent and a gas to foam the liquid agent into a foamed liquid agent; a discharge opening configured to discharge the foamed liquid agent; and a flow path in communication with the discharge opening, and configured to supply the foamed liquid agent from the mixing portion to the discharge opening. The discharge opening is provided with a first porous member. On an upstream side of the first porous member, a cross-sectional area of the flow path on a cross section orthogonal to a supply direction in which the foamed liquid agent is to be supplied increases along the supply direction. The cross-sectional area of the flow path at the discharge opening is at least 1.2 times a minimum cross-sectional area of the flow path.

The invention relates to a foam discharger including: a mixing portion configured to mix a liquid agent and a gas to foam the liquid agent into a foamed liquid agent; and a discharge opening configured to discharge the foamed liquid agent. The mixing portion includes: gas/liquid contact chambers, each configured to make the liquid agent and the gas contact one another; a plurality of liquid-agent flow paths configured to supply the liquid agent respectively to the gas/liquid contact chambers; gas flow paths, each configured to supply the gas respectively to the gas/liquid contact chambers; and foam flow paths, each configured to supply the foamed liquid agent respectively from the gas/liquid contact chambers toward the discharge opening. At a location where the gas flow path and the gas/liquid contact chamber intersect with one another, the gas flow path extends on a first plane that intersects with a direction in which the foam flow path extends.

DESCRIPTION OF EMBODIMENTS

Figure 1:
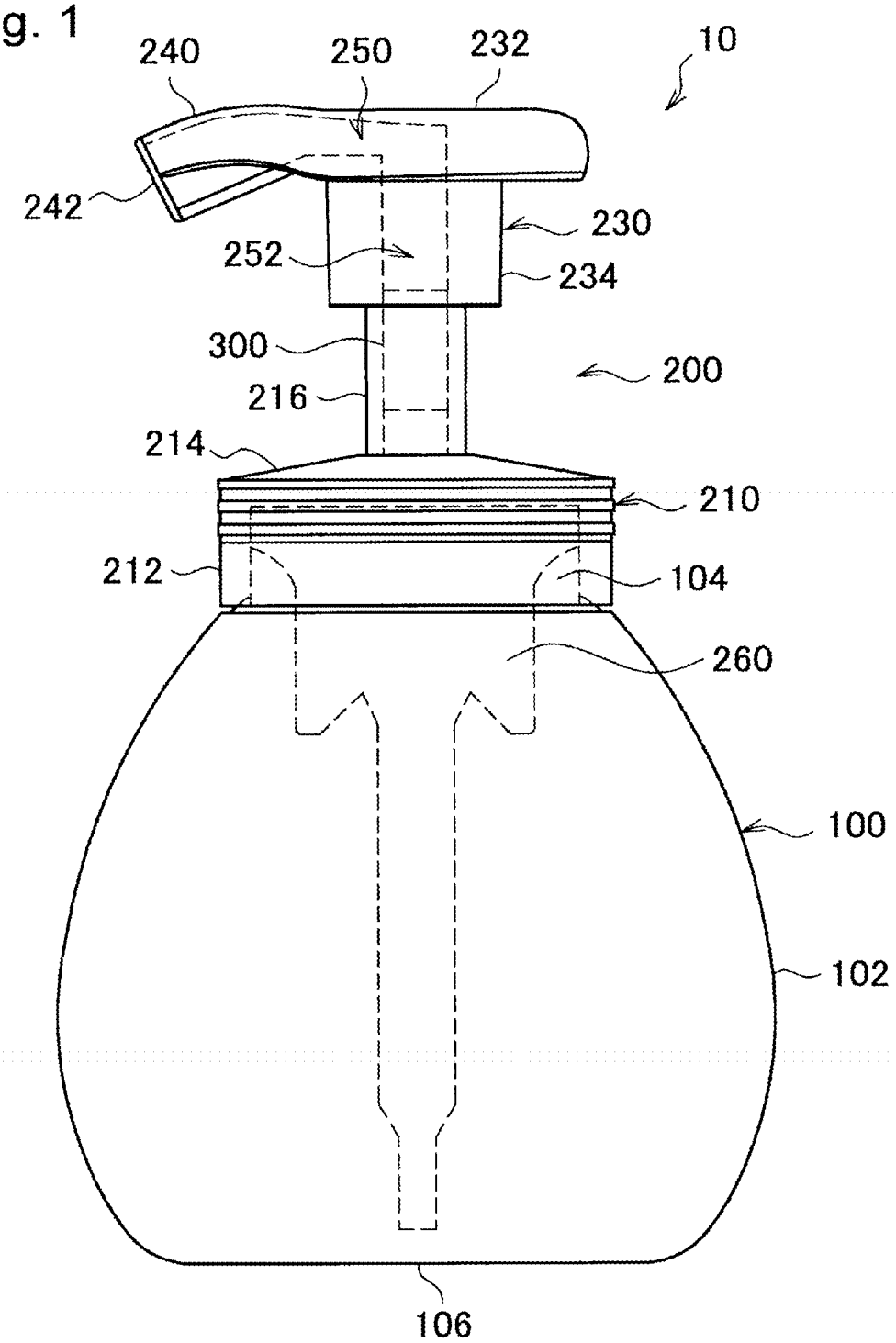
FIG. 1 is an explanatory diagram illustrating an appearance of a foam-discharging container 10 according to a first embodiment of the invention.

Conventional foam dischargers may be incapable of producing fine and uniform foams depending on how a user uses the foam discharger or on properties of the liquid agent contained in the foam discharger. Conventional foam dischargers may also be incapable of sufficiently mixing a liquid agent and gas to produce a foamed liquid agent containing a sufficient amount of gas.

The present invention relates to a foam discharger capable of discharging a fine liquid agent foam with improved uniformity. The present invention also relates to a foam discharger capable of further increasing the content of gas in a foamed liquid agent.

Preferred embodiments of the invention will be described in detail below with reference to the accompanying drawings. In the present Description and drawings, constituent elements having substantially the same function/configuration are accompanied by the same reference sign, and repetitive explanation thereon is omitted. Further, in the present Description and drawings, similar constituent elements in different embodiments may be distinguished from one another by attaching different alphabets after the same reference number. Note, however, that similar constituent elements may be accompanied by the same reference sign in cases where there is no need to particularly distinguish those constituent elements.

The drawings referenced in the following description are for facilitating the explanation and understanding of the various embodiments of the invention, and for the sake of facilitating understanding, the shapes, dimensions, ratios, etc., of members illustrated in the drawings may differ from those in practice. Hereinbelow, a description of a concrete shape does not refer only to the exact geometrical shape, but also encompasses similar shapes thereto having differences permissible in terms of manufacture and use of the foam-discharging container. For example, the expression "disk shaped" hereinbelow is not limited to the shape of a plate having a perfect-circular surface, but also encompasses plates having surface shapes similar to a perfect circle, such as elliptic. Further, hereinbelow, the expression "substantially the same" used to describe a concrete diameter or length does not refer only to dimensions that exactly match either mathematically or geometrically, but also encompasses dimensions or lengths having differences (e.g., play (leeway) to facilitate manufacture) permissible in terms of manufacture and use of the foam-discharging container.

Hereinbelow, "up-down direction" is defined with reference to a foam-discharging container according to embodiments of the invention. More specifically, herein, "up-down direction" refers to the up-down (vertical) direction in a state where a foam-discharging container (described below) is arranged such that its container body for containing a liquid agent is located on the lower side, and its foam-discharging cap is located on the upper side. Note, however, that this "up-down direction" may differ from the up-down direction of the foam-discharging container during manufacture or use thereof or from the up-down direction of each of the elements (components) constituting the foam-discharging container. Hereinbelow, "upstream" and "downstream" refer to relative positions in the flow of a gas, a liquid agent, or a foamed liquid agent. More specifically, in relation to the flow thereof, a position close to the start point of the flow is referred to as "upstream", whereas a position relatively farther from the start point than an "upstream" point is referred to as "downstream".

Hereinbelow, a "foamed liquid agent" refers to a liquid agent that has taken in gas bubbles and has thereby incorporated a multitude of gas bubbles (foam cells) having a spherical shape or a shape similar to a sphere. Hereinbelow, the size of the gas bubbles (more specifically, e.g., the diameter of the sphere) included in the foamed liquid agent, the distribution density of the gas bubbles, etc., are not particularly limited; for example, the size and/or the distribution density of the gas bubbles may be varied depending on, for example, the use of the liquid agent.

First Embodiment

Schematic Configuration of Foam-Discharging Container 10:

First, a foam-discharging container 10 according to a first embodiment of the invention will be described. The foam-discharging container 10 according to the first embodiment of the invention is a container capable of mixing a liquid agent contained in a later-described container body 100 and a gas taken in from outside the container body 100 to thereby transform the liquid agent into a foam, and discharging the foamed liquid agent to outside the foam-discharging container 10. Below, a schematic configuration of the foam-discharging container 10 according to the first embodiment of the invention will be described with reference to FIG. 1. FIG. 1 is an explanatory diagram illustrating an appearance of the foam-discharging container 10 according to the present embodiment.

As illustrated in FIG. 1, the foam-discharging container 10 according to the present embodiment mainly includes: a container body 100 configured to be filled with a liquid agent; and a foam-discharging cap (foam discharger) 200 configured to be detachably attached to the container body 100. More specifically, the foam-discharging container 10 is a container, called a pump foamer, including a hand-operated pump, wherein, as a result of a user pressing a head portion 230 of the foam-discharging cap 200 downward with his/her fingers etc., the liquid agent can be transformed into a foam and discharged. Stated differently, hereinbelow, the foam-discharging container 10 is described as a pump foamer-type container. An overview of various parts of the foam-discharging container 10 will be described below.

Container Body 100:

The container body 100 is located on a lower side of the foam-discharging container 10, and has a space capable of being filled with a liquid agent. For example, as illustrated in FIG. 1, the container body 100 includes: a cylindrical (circular tube-shaped) body portion 102; a cylindrical neck portion 104 that is connected to the body portion 102 on the upper side thereof; and a bottom portion 106 that closes a lower end of the body portion 102. More specifically, the lower end of the body portion 102 is closed off by the bottom portion 106, and thereby, the body portion is provided with a space for storing a liquid agent. The neck portion 104 is provided with an opening, and a portion of the later-described foam-discharging cap 200 is insertable in this opening. It should be noted that, in the present embodiment, the shape of the container body 100 is not limited to the shape illustrated in FIG. 1, but may have a different shape.

The liquid agent to be contained in the container body 100 is not particularly limited, and may be one of various liquid agents used as a foam, with examples including face wash, hand soaps, body soaps, cleansing agents, various detergents for dishwashing, bathrooms, etc., hairdressing agents, shaving creams, cosmetics for the skin such as foundation creams, serums, etc., hair dye agents, and antiseptic agents. The viscosity of the liquid agent is not particularly limited, and may be, for example, preferably 2 cP (centipoise) or greater, or from 10 to 20000 cP, and more preferably 20 cP or greater, even more preferably 30 cP or greater, and more preferably 10000 cP or less, even more preferably 2000 cP or less, at 25° C. The viscosity of the liquid agent can be measured, for example, by using a B-type viscometer. As regards measurement conditions for measuring the viscosity, it is possible to select, as appropriate, the rotator type, rotation speed and rotation time as defined in accordance with the viscosity level for each viscometer.

Foam-Discharging Cap 200:

As illustrated in FIG. 1, the foam-discharging cap 200 is a foam-discharging cap 200 that is configured to be attached to the container body 100 for storing the liquid agent and supported by the container body 100 thereabove. The foam-discharging cap 200 mainly includes: a supply mechanism 260 for supplying the liquid agent from the container body 100; a foamer mechanism (mixing portion) 300 for mixing the liquid agent and a gas to foam the liquid agent into a foamed liquid agent; and a head portion 230 having a discharge opening 242 for discharging the foamed liquid agent. More specifically, the foam-discharging cap 200 can be detachably attached to the neck portion 104 of the container body 100 by a fastening method such as screwing. The foam-discharging cap 200 mainly includes: a cap member 210 configured to be attached to the neck portion 104; a head portion 230 supported by the cap member 210; and a supply mechanism 260 hanging down from the cap member 210. The foam-discharging cap 200 also includes a flow path that is in communication with the discharge opening 242 and that is configured to supply the foamed liquid agent from the foamer mechanism 300 to the discharge opening 242.

More specifically, the cap member 210 has a cylindrical attachment portion 212, and by, for example, screwing the attachment portion 212 onto the neck portion 104, the whole foam-discharging cap 200 can be attached to the container body 100. Stated differently, by attaching the foam-discharging cap 200 onto the neck portion 104, the foam-discharging cap 200 closes the opening in the neck portion 104. The attachment portion 212 may be formed with a double-cylinder structure; in this case, the inner cylinder of the attachment portion 212 will be attached—e.g. screwed—onto the neck portion 104. Further, the cap member 210 includes: an annular closing portion 214 that closes an upper end portion of the attachment portion 212; and an upright tube portion 216 that rises upward from a central portion of the annular closing portion 214 (i.e., a central portion in a planar view of the annular closing portion 214). The upright tube portion 216 has a circular-cylindrical shape having a smaller diameter than the attachment portion 212. A portion of the later-described supply mechanism 260 is inserted within the upright tube portion 216.

As described above, the supply mechanism 260 is provided so as to hang down from the upright tube portion 216. The supply mechanism 260 includes: a liquid-agent supplying portion (not illustrated) for supplying the liquid agent stored in the container body 100 to the foamer mechanism 300, which is configured to mix the liquid agent with a gas and transform the liquid agent into a foam; and a gas supplying portion (not illustrated) for taking in a gas from outside the foam-discharging container 10 and supplying the gas to the foamer mechanism 300. More specifically, the liquid-agent supplying portion is, for example, a liquid-agent cylinder constituting a liquid-agent pump, and is configured to pressurize the liquid agent inside a liquid-agent pump chamber (not illustrated) provided within the supply mechanism 260 and supply the liquid agent to the foamer mechanism 300. The gas supplying portion is, for example, a gas cylinder constituting a gas pump, and is configured to pressurize a gas inside a gas pump chamber (not illustrated) provided within the supply mechanism 260 and supply the gas to the foamer mechanism 300. Note that, in the present embodiment, the configuration of the liquid-agent supplying portion and the gas supplying portion is not particularly limited, and various known configurations are applicable. The upper end of the supply mechanism 260 is either closed off by the foamer mechanism 300 or is in communication with the foamer mechanism 300 through a flow path (not illustrated).

The foamer mechanism 300 is provided so as to be contained within the upright tube portion 216 and a cylindrical portion 234, and is capable of mixing the liquid agent and a gas and transforming the liquid agent into a foam. Note that, hereinbelow, the "gas" to be mixed with the liquid agent in the foamer mechanism 300 refers to air (outside air) that is taken in from outside the foam-discharging container 10 and that contains nitrogen, oxygen, carbon dioxide, etc. In the present embodiment, however, the gas is not limited to air, and may be, for example, a gas containing various gaseous components and stored in advance in the container body 100 etc. Details on the foamer mechanism 300 will be described further below.

As illustrated in FIG. 1, the head portion 230 includes a nozzle portion 240 provided as an integral object with the head portion 230. The discharge opening 242 for discharging the foamed liquid agent is provided at the tip end of the nozzle portion 240. An interior space of the nozzle portion 240 is provided with a foam flow path 250 for supplying the foamed liquid agent toward the discharge opening 242. The foam flow path 250 extends outward from the head portion 230, and is in communication with the discharge opening 242. The foam flow path 250 may extend in a manner sloping downward toward the discharge opening 242 as illustrated in FIG. 1, or may extend along the horizontal direction. The side of the foam flow path 250 opposite from the discharge opening 242—i.e., the upstream side of the foam flow path 250—is in communication with a communication flow path 252 which constitutes an interior space of a later-described cylindrical portion 234. The communication flow path 252 is in communication with the foamer mechanism 300. More specifically, in the present embodiment, the foam-discharging cap 200 includes the foam flow path 250 and the communication flow path 252 as a "flow path"; thus, the liquid agent foamed in the foamer mechanism 300 can pass through the communication flow path 252 and the foam flow path 250, and can be discharged from the discharge opening 242 to outside the foam-discharging container 10. Detailed configuration of the head portion 230 will be described further below.

In the present embodiment, a porous element (first porous member) 270 (see FIGS. 2 and 4) is provided to the discharge opening 242. The porous element 270 is provided so as to close the discharge opening 242. The liquid agent foamed by the foamer mechanism 300 further passes through the porous element 270, and is thereby made into a finer foam. Preferably, the porous element 270 is located within 10 mm from the opening end of the discharge opening 242. Stated differently, the length of the foam flow path 250 from the porous element 270 to the opening end (discharge opening end) 242*a* (see FIG. 4) of the discharge opening 242 is 10 mm or less, more preferably 8 mm or less. Details on the porous element 270 will be described further below.

The head portion 230 is configured so as to be movable along the up-down direction. More specifically, as illustrated in FIG. 1, the head portion 230 is provided with an operation portion 232 configured to receive pressing operation by the fingers etc. of a user. Note that, as illustrated in FIG. 1, the aforementioned nozzle portion 240 is provided so as to project from the operation portion 232. More specifically, in a case where the operation portion 232 is subjected to pressing operation and the head portion 230 is pressed down relatively to the attachment portion 212, the aforementioned liquid-agent supplying portion (not illustrated) pressurizes the liquid agent within the liquid-agent pump chamber (not illustrated) and supplies the liquid agent to the foamer mechanism 300, and also, the aforementioned gas supplying portion (not illustrated) pressurizes the gas within the gas pump chamber (not illustrated) and supplies the gas to the foamer mechanism 300. The head portion 230 also includes a cylindrical portion 234 that hangs downward from the operation portion 232. As described above, the communication flow path 252, which extends in the up-down direction, is provided inside the cylindrical portion 234. The communication flow path 252 is in communication with the upper end of the foamer mechanism 300 and is also in communication with the upstream side of the foam flow path 250.

Figure 2:
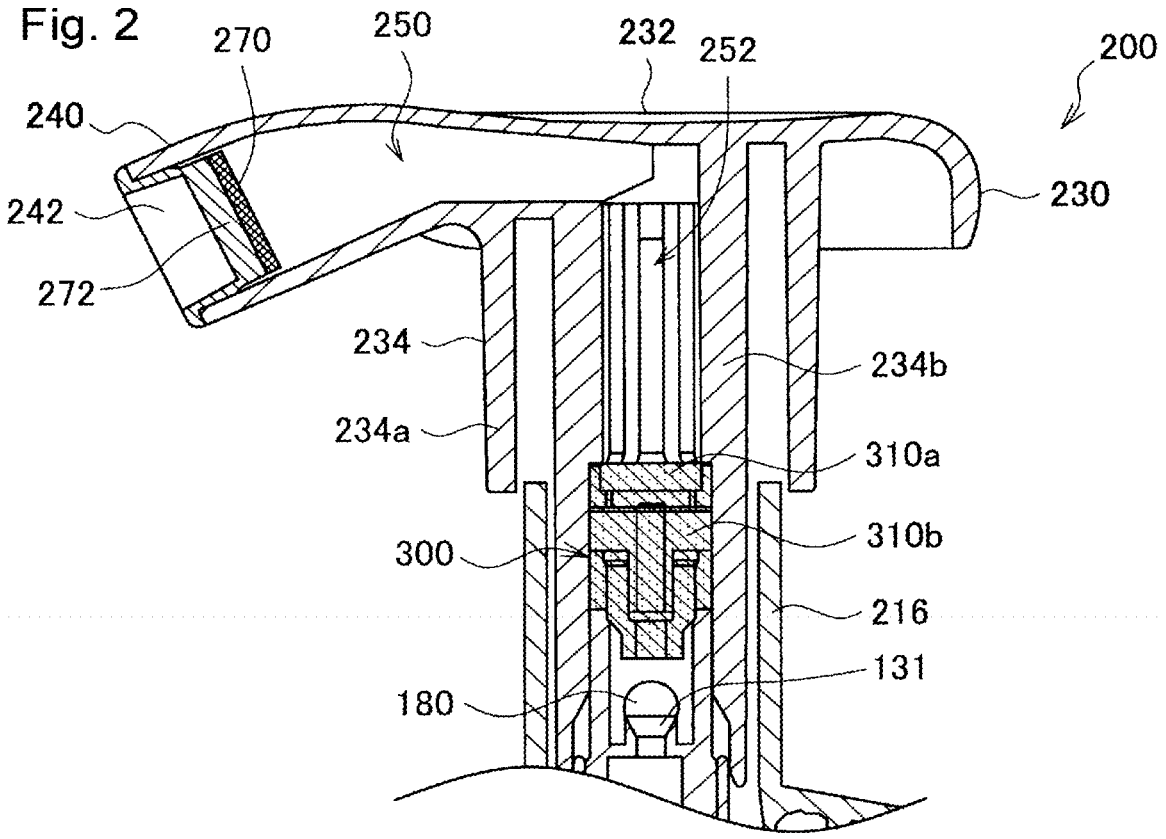
FIG. 2 is an explanatory diagram illustrating a portion of a sectional side view of a foam-discharging cap 200 according to the first embodiment of the invention.

Schematic Configuration of Foamer Mechanism 300:

Next, a schematic configuration of the aforementioned foamer mechanism 300 will be described with reference to FIG. 2. FIG. 2 is an explanatory diagram illustrating a portion of a sectional side view of the foam-discharging cap 200 according to the present embodiment, and more specifically, illustrates a portion of a side section of the foam-discharging cap 200 of FIG. 1 cut along the center axis of the foam-discharging container 10.

As described above, the foamer mechanism 300 is a mechanism for mixing a liquid agent and a gas to thereby transform the liquid agent into a foam. As illustrated in FIG. 2, the foamer mechanism is housed in an inner cylindrical portion 234*b* of the cylindrical portion 234 of the head portion 230. As described above, the upper end of the foamer mechanism 300 is in communication with the communication flow path 252 of the cylindrical portion 234, and the communication flow path 252 is in communication with the foam flow path 250 of the nozzle portion 240. Thus, the liquid agent foamed in the foamer mechanism 300 can be discharged to outside the foam-discharging container 10 through the discharge opening 242 of the nozzle portion 240.

A lower end of the foamer mechanism 300 opposes a check valve that is constituted by a ball valve 180 and a valve seat portion 131 provided inside the supply mechanism 260, and that permits liquid to be supplied to the foamer mechanism 300. With this configuration, the up-down movement of the ball valve 180 of the check valve can supply the foamer mechanism 300 with the liquid agent from the liquid-agent supplying portion (not illustrated) located below the ball valve 180, and can inhibit the liquid from returning from the foamer mechanism 300 to the liquid-agent supplying portion.

The foamer mechanism 300 also has, in the interior thereof, one or more liquid-agent flow paths (not illustrated) for the liquid agent supplied from the liquid-agent supplying portion and one or more gas flow paths (not illustrated) for the gas supplied from the gas supplying portion (not illustrated) of the supply mechanism 260. The foamer mechanism 300 also has, in the interior thereof, a mixing chamber (not illustrated) where the liquid-agent flow path and the gas flow path intersect with one another. In the mixing chamber, the liquid agent and the gas having been supplied can be mixed together, and the liquid agent can be made into a foam. The foamed liquid agent is emitted from the mixing chamber to the communication flow path 252 by being expelled by the liquid agent and gas supplied anew to the foamer mechanism 300. Further, as described above, the emitted liquid-agent foam will flow through the communication flow path 252 and the foam flow path 250 and be discharged from the discharge opening 242 to outside the foam-discharging container 10.

The foamer mechanism 300 also includes, in the interior thereof, a porous element (second porous member) 310. The porous element 310 is, for example, disk-shaped or circular-columnar, and is provided in a position capable of contacting the foamed liquid agent from the mixing chamber. Thus, the liquid agent foamed in the mixing chamber passes through the porous element 310, and is thereby made into a finer foam.

In the present embodiment, the porous element 310 may be, for example, a mesh, gauze, foam, sponge, or a combination including at least two selected from the above. More specifically, the size of the mesh opening of the porous element 310 may be, for example, preferably 20μm or greater, more preferably 40 μm or greater, and preferably 350 μm or less, more preferably 300 μm or less, although not particularly limited thereto. In cases where the porous element 310 is a mesh having rectangular openings, the mesh opening refers to the longitudinal/lateral length of the rectangular opening; in cases where the openings are circular, the mesh opening refers to the diameter of the circle. More specifically, for the porous element 310, it is possible to use, for example, a commercially available mesh sheet having a mesh size of from #50 to #550, and preferably, a commercially available mesh sheet having a mesh size of from #85 to #350. For example, it is possible to use a #61, #508, #85, or #305 mesh sheet.

Further, in the present embodiment, as illustrated in FIG. 2, the foamer mechanism 300 may include two porous elements, i.e., a porous element (second porous member located on the downstream side) 310*a*, and a porous element (second porous member located on the upstream side) 310*b*. More specifically, the porous element 310*a* is provided to the upper end of the foamer mechanism 300 (i.e., on the downstream side), and may be in communication with the communication flow path 252. In this case, the liquid agent foamed in the mixing chamber will pass successively through the porous elements 310*b*, 310*a*, and can thereby be made into a finer foam. In the present embodiment, the foamer mechanism 300 may include three or more porous elements; the number of porous elements is not particularly limited.

Figure 3:
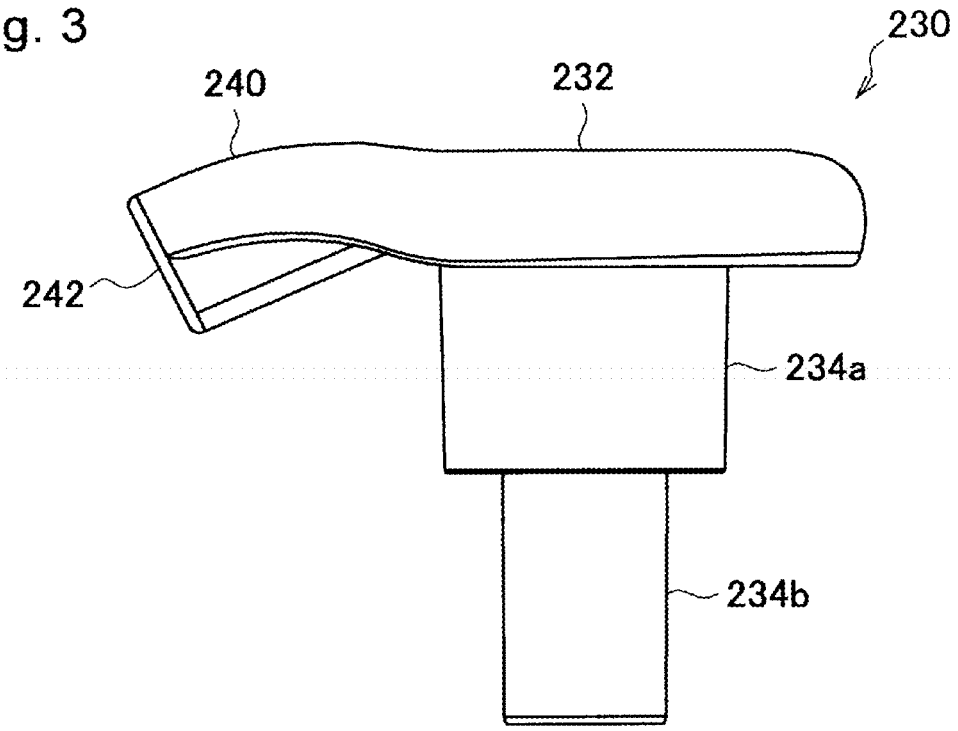
FIG. 3 is an explanatory diagram illustrating an appearance of a head portion 230 according to the first embodiment of the invention.
Figure 4:
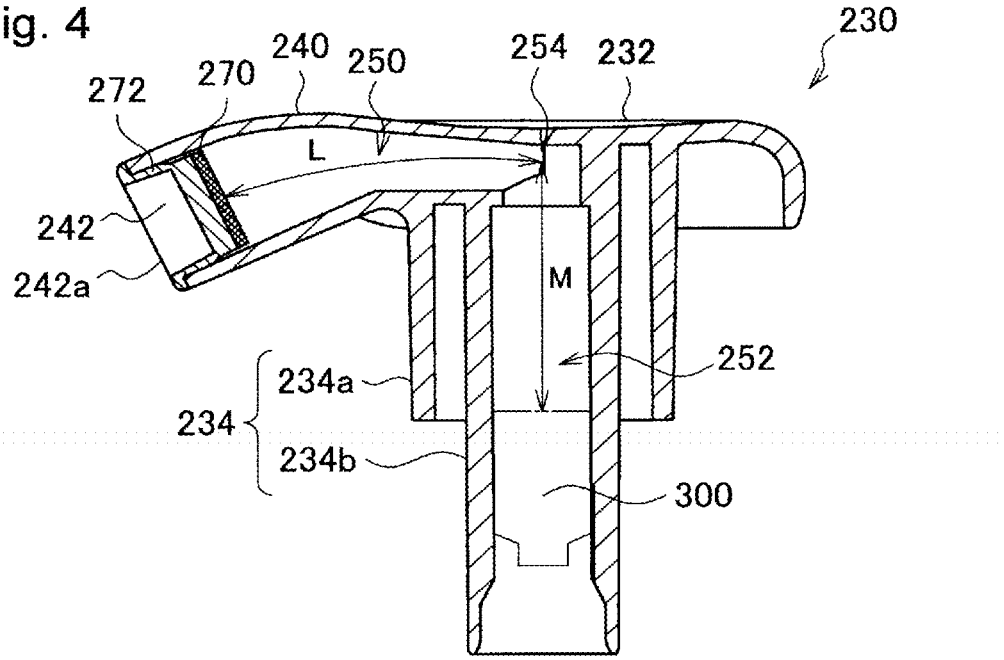
FIG. 4 is an explanatory diagram illustrating a sectional side view of the head portion 230 according to the first embodiment of the invention.
Figure 5:
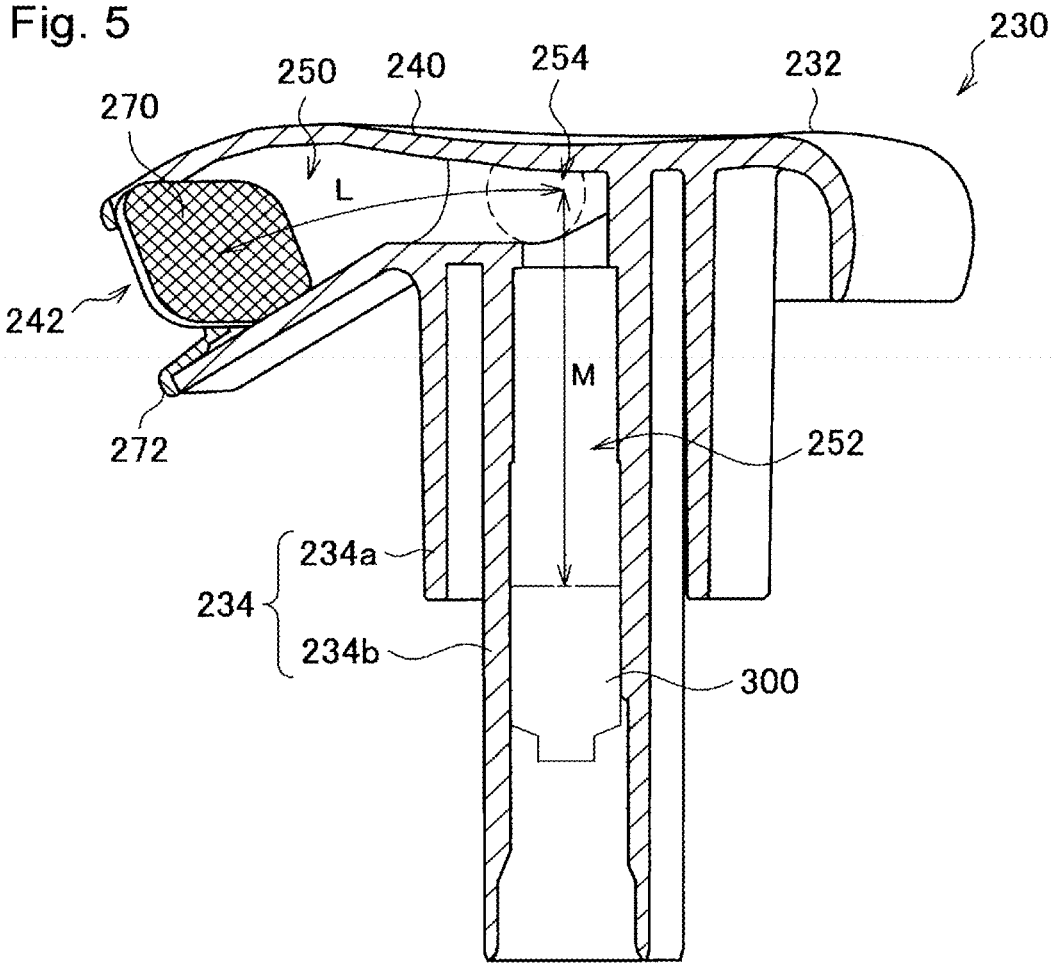
FIG. 5 is a perspective view of the side section illustrated in FIG. 4.

Detailed Configuration of Head Portion 230:

Next, a detailed configuration of the aforementioned head portion 230 will be described with reference to FIGS. 2 to 5. FIG. 3 is an explanatory diagram illustrating an appearance of the head portion 230 according to the present embodiment. FIG. 4 is an explanatory diagram illustrating a sectional side view of the head portion 230 according to the present embodiment, and more specifically, illustrates a side section of the head portion 230 of FIG. 3, cut along the center axis of the foam-discharging container 10. FIG. 5 is a perspective view of the side section illustrated in FIG. 4, and more specifically, is a diagram of the side section of the head portion 230 illustrated in FIG. 4, rotated about the center axis. FIG. 5 illustrates the porous element 270 in a non-cut state.

As described above, as illustrated in FIGS. 2 and 3, the head portion 230 of the present embodiment mainly includes: the nozzle portion 240 having the discharge opening 242 configured to discharge the foamed liquid agent; the operation portion 232 configured to receive pressing operation by the fingers etc. of a user; and the cylindrical portion 234 that hangs downward from the operation portion 232. The nozzle portion 240, the operation portion 232, and the cylindrical portion 234 may be, for example, molded integrally by a resin material. Detailed configurations of the various parts of the head portion 230 will be described below.

Operation Portion 232:

As described above, the operation portion 232 is capable of receiving pressing operation by the fingers etc. of a user. In the present embodiment, by pressing of the operation portion 232 by the user, the head portion 230 is pressed down.

Cylindrical Portion 234:

As illustrated in FIG. 2, the cylindrical portion 234 has a double-cylinder structure, and includes an outer cylindrical portion 234*a* and an inner cylindrical portion 234*b*. A portion of the inner cylindrical portion 234*b* is inserted in the upright tube portion 216 of the cap member 210. The cylindrical portion 234 is indirectly supported by the aforementioned supply mechanism 260 and a biasing member (not illustrated) provided to the supply mechanism 260. Thus, the head portion 230 can be pressed down (lowered) within a predetermined range against the biasing force from the biasing member. More specifically, as illustrated in FIG. 2, in a state where the pressing operation to the operation portion 232 is released, the head portion 230 ascends relatively to the upright tube portion 216 of the cap member 210 along the up-down direction, in accordance with the bias of the biasing member, and moves to the upper stop point. On the other hand, by the pressing operation applied by the user to the operation portion 232 against the bias from the biasing member, the head portion 230 descends relatively to the upright tube portion 216. At this time, the head portion 230 can move along the up-down direction while securing a narrow flow path that allows intake of air between the upright tube portion 216 and the cylindrical portion 234's inner cylindrical portion 234*b* and inner cylindrical portion 234*b*.

As illustrated in FIG. 2, the aforementioned foamer mechanism 300 is provided to the lower side of the inner cylindrical portion 234*b*. Further, the communication flow path 252, which extends along the up-down direction and is in communication with the upper end of the foamer mechanism 300, is provided in the upper section of the inner cylindrical portion 234*b*. The communication flow path 252 allows the liquid agent foamed by the foamer mechanism 300 to pass therethrough, and thereby, the foamed liquid agent is supplied to the foam flow path 250 of the head portion 230. The cross-sectional shape of the communication flow path 252 (more specifically, a cross section when the communication flow path is cut along the horizontal direction) is not particularly limited, and may be, for example, circular or rectangular. Details on the length of the communication flow path 252 will be described further below.

Nozzle Portion 240:

As illustrated in FIG. 3, the nozzle portion 240 has the discharge opening 242 at the tip end thereof, and has a shape that projects from the operation portion 232 and slopes downward toward the discharge opening 242. Further, as described above, the foam flow path 250 through which the foamed liquid agent passes is provided as an interior space of the nozzle portion 240, as illustrated in FIGS. 2 and 4. The inner diameter of the foam flow path 250 increases toward the discharge opening 242 from a connecting portion 254 (see FIG. 4) where the foam flow path and the communication flow path 252 are connected. In the present embodiment, the inner diameter of the foam flow path 250 gradually increases from the connecting portion 254 toward the discharge opening 242. Stated differently, the cross-sectional area of the foam flow path 250 on a cross section orthogonal to the supply direction in which the foamed liquid agent is to be supplied (i.e., the direction in which the foamed liquid agent flows) gradually increases along the supply direction toward the discharge opening 242. Details on the gradual increase of the cross-sectional area of the foam flow path 250 will be described further below.

It should be noted that the shape of the cross section of the foam flow path 250 is not particularly limited; it may be, for example, rectangular, rectangular with rounded corners, circular, or elliptic.

Further, as illustrated in FIG. 2, a porous fitting member 272 is provided to the tip end of the nozzle portion 240. The porous fitting member 272 is a circular-cylindrical or rectangular-cylindrical member having an inner diameter that is equal to or slightly smaller than the inner diameter on the discharge opening 242 side of the foam flow path 250. The porous fitting member is capable of being fitted inside the tip end of the nozzle portion 240. The porous element 270 is provided on the inner diameter of the porous fitting member 272. In the present embodiment, by using the porous fitting member 272 which is capable of being fitted inside the tip end of the nozzle portion 240, the porous element 270 can be provided easily to the discharge opening 242 of the nozzle portion 240. Stated differently, in the present embodiment, the head portion 230 of the present embodiment can be manufactured easily by using the porous fitting member 272. In addition, in the present embodiment, by using the porous fitting member 272, the porous element 270 can be provided to the discharge opening 242 without impairing the appearance of the nozzle portion 240.

The porous element 270 is a member having, for example, a plate-like, rectangular-columnar, disk-like, or circular-columnar shape. By passing through the porous element 270, the foamed liquid agent supplied from the foamer mechanism 300 can be made into a finer foam.

Like the porous element 310 of the foamer mechanism 300, the porous element 270 may be, for example, a mesh, gauze, foam, sponge, or a combination including at least two selected from the above. More specifically, the size of the mesh opening of the porous element 270 may be, for example, preferably 20 μm or greater, more preferably 40 μm or greater, and preferably 350 μm or less, more preferably 300 μm or less, although not particularly limited thereto. In cases where the porous element 270 is a mesh having rectangular openings, the mesh opening refers to the longitudinal/lateral length of the rectangular opening; in cases where the openings are circular, the mesh opening refers to the diameter of the circle. More specifically, for the porous element 270, it is possible to use, for example, a commercially available mesh sheet having a mesh size of from #50 to #550, and preferably, a commercially available mesh sheet having a mesh size of from #85 to #350. For example, it is possible to use a #61, #508, #85, or #305 mesh sheet.

As illustrated in FIGS. 4 and 5, the cross-sectional area of the foam flow path 250 becomes the smallest at the connecting portion 254 where the foam flow path 250 and the communication flow path 252 are connected. Stated differently, the connecting portion 254 can be considered a position of minimum cross-sectional area where the cross-sectional area becomes the smallest. In the present embodiment, it is preferable that the length L of the foam flow path 250, along the supply direction of the foamed liquid agent, from the porous element 270 to the connecting portion 254, where the cross-sectional area of the flow path becomes the smallest, is 3 mm or greater. In the present embodiment, the length L is more preferably 10 mm or greater, even more preferably 20 mm or greater. In the present embodiment, by increasing the length L, it is possible to reduce the difference in flow velocity (i.e., make the flow velocity uniform) between the liquid agent flowing near the center of the flow path and the liquid agent flowing near the wall surface, thereby enabling production of a foam with improved uniformity. Note that the length L can be restated as the length of the center line of the foam flow path 250 passing through the center of the cross section of the foam flow path 250.

It should be noted that, in the present embodiment, the location where the cross-sectional area becomes the smallest is not limited to the connecting portion 254 where the foam flow path 250 and the communication flow path 252 are connected, and it may be any location within the foam flow path 250 between the connecting portion 254 and the porous element 270. Even in this case, it is preferable that the length L of the foam flow path 250, along the supply direction of the foamed liquid agent, from the porous element 270 to the location where the cross-sectional area becomes the smallest is 3 mm or greater. Also in this case, the length is more preferably 10 mm or greater, even more preferably 20 mm or greater.

In the present embodiment, the length M of the communication flow path 252 from the connecting portion 254, where the communication flow path and the foam flow path 250 are connected, to the mixing chamber of the foamer mechanism 300, as illustrated in FIGS. 4 and 5, is preferably 12 mm or greater. In the present embodiment, the length M is more preferably 15 mm or greater, even more preferably 20 mm or greater. The length M can be restated as the length of the center line of the communication flow path 252 passing through the center of the cross section of the communication flow path 252.

Therefore, the start point of the length L and the length M at the connecting portion 254 can be defined as the point where the center line of the foam flow path 250 and the center line of the communication flow path 252 intersect with one another. In the present embodiment, by increasing the length M, it is possible to further reduce the flow velocity when the foamed liquid agent passes through the porous element 270 of the discharge opening 242, thereby enabling production of a fine foam with improved uniformity.

Stated differently, in the present embodiment, the length (L+M), along the supply direction of the foamed liquid agent, of the foam flow path 250 and the communication flow path 252 from the porous element 270 to the mixing chamber of the foamer mechanism 300 is preferably 15 mm or greater. In the present embodiment, the length (L+M) is more preferably 25 mm or greater, even more preferably 40 mm or greater. In cases where the foamer mechanism 300 includes a plurality of porous elements 310, it is preferable that the length of the foam flow path 250 and the communication flow path 252 from the porous element 270 to the most upstream porous element **310*b* of the foamer mechanism 300 is 10 mm or greater. The length from the porous element 270 to the most upstream porous element 310*b* of the foamer mechanism 300** is more preferably 20 mm or greater, even more preferably 35 mm or greater.

To produce a foam with further improved fineness and uniformity, it is preferable to reduce the flow velocity that the foamed liquid agent passes through the porous element 270 of the discharge opening 242. For this reason, in the present embodiment, the length of the foam flow path 250 and the communication flow path 252 is increased, as described above. It is, however, not realistic to unlimitedly increase the length of the foam flow path 250 and the communication flow path 252, because there are constraints in the size and shape of the foam-discharging container 10 considering, for example, the usability of the foam-discharging container 10. So, the present embodiment focuses on the flow path diameter of the foam flow path 250 and gradually increases the cross-sectional area of the foam flow path 250 toward the discharge opening 242. In this way, even when there are constraints in the length of the foam flow path 250 and the communication flow path 252, it is possible to further reduce the flow velocity that the foamed liquid agent passes through the porous element 270 of the discharge opening 242.

More specifically, as described above, the cross-sectional area of the foam flow path 250 becomes the smallest at the connecting portion 254 where the foam flow path 250 and the communication flow path 252 are connected. Further, in the present embodiment, on the upstream side of the porous element 270, the cross-sectional area of the foam flow path 250 on a cross section orthogonal to the supply direction, in which the foamed liquid agent is to be supplied, gradually increases along the supply direction of the foamed liquid agent from the connecting portion 254 toward the discharge opening 242. More specifically, as illustrated in FIG. 5, the cross-sectional area of the foam flow path 250 at the discharge opening 242 is preferably at least 1.2 times the cross-sectional area (minimum cross-sectional area) of the foam flow path 250 at the connecting portion 254. Further, in the present embodiment, the cross-sectional area of the foam flow path 250 at the discharge opening 242 is more preferably at least 3 times the minimum cross-sectional area. Thus, in the present embodiment, the cross-sectional area of the porous element 270 (more specifically, the cross-sectional area on a cross section orthogonal to the supply direction) is preferably at least 1.2 times, more preferably at least 3 times, the minimum cross-sectional area.

It should be noted that the present embodiment is not limited to a configuration wherein, on the upstream side of the porous element 270, the cross-sectional area of the foam flow path 250 on a cross section orthogonal to the supply direction of the foamed liquid agent gradually increases along the supply direction of the foamed liquid agent from the connecting portion 254 toward the discharge opening 242. Instead, the cross-sectional area of the cross section may increase stepwise on the upstream side of the porous element 270 along the supply direction from the connecting portion 254 toward the discharge opening 242.

In the present embodiment, by increasing the cross-sectional area of the foam flow path 250 on the upstream side of the porous element 270 along the supply direction, it is possible to reduce the flow velocity when the foamed liquid agent passes through the porous element 270, thereby enabling production of a fine foam with improved uniformity. More specifically, in the present embodiment, it is assumed that: by reducing the flow velocity of the foamed liquid agent, it is possible to uniformize the liquid agent passing through the foam flow path 250 by the action of laminar flow generated therein; and further, by causing the uniformized liquid agent to pass through the porous element 270 at low speed, it is possible to obtain a fine foam with improved uniformity. Particularly, by gradually increasing the cross-sectional area of the foam flow path 250 on the upstream side of the porous element 270 toward the discharge opening 242, it is possible to further promote the creation of laminar flow inside the foam flow path 250 and thereby uniformize the liquid agent passing therethrough, and further, by causing the uniformized liquid agent to pass through the porous element 270 at low speed, it is possible to obtain a fine foam with further improved uniformity.

It should be noted that, in the present embodiment, as described above, the location where the cross-sectional area becomes the smallest is not limited to the connecting portion 254 where the foam flow path 250 and the communication flow path 252 are connected, and it may be any location within the foam flow path 250 between the connecting portion 254 and the porous element 270. Even in this case, it is preferable that the cross-sectional area of the foam flow path 250 at the discharge opening 242 is at least 1.2 times, more preferably at least 3 times, the minimum cross-sectional area.

As described above, the present embodiment can provide a foam-discharging container 10 capable of discharging a fine liquid agent foam with further improved uniformity. Further, since the foam-discharging container 10 of the present embodiment does not require significant changes in shape/configuration from conventional foam-discharging containers, production line modification can be kept minimal, and also, the foam-discharging container compares favorably with conventional foam-discharging containers in terms of usability and appearance.

Second Embodiment

A head portion 230 according to an embodiment of the invention may have a different shape/configuration from the head portion 230 of the foregoing first embodiment. Below, a head portion 230*a* having a different shape/configuration will be described in detail as a head portion according to a second embodiment of the invention.

Figure 6:
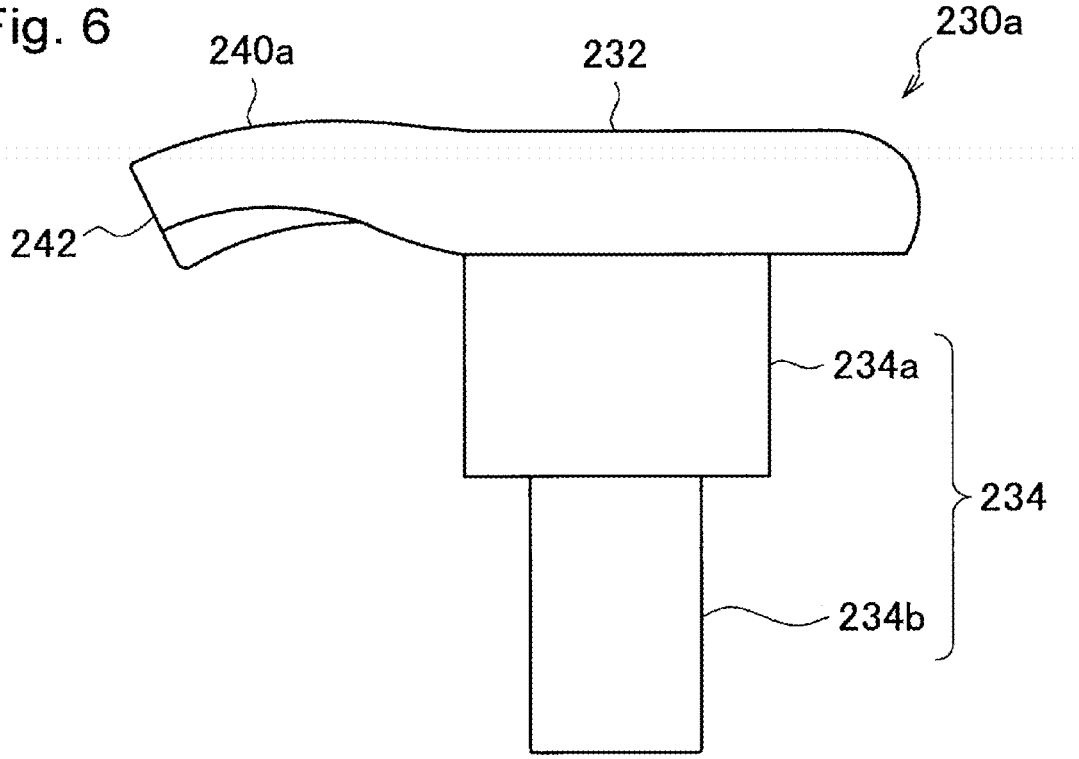
FIG. 6 is an explanatory diagram illustrating an appearance of a head portion 230*a* according to a second embodiment of the invention.
Figure 7:
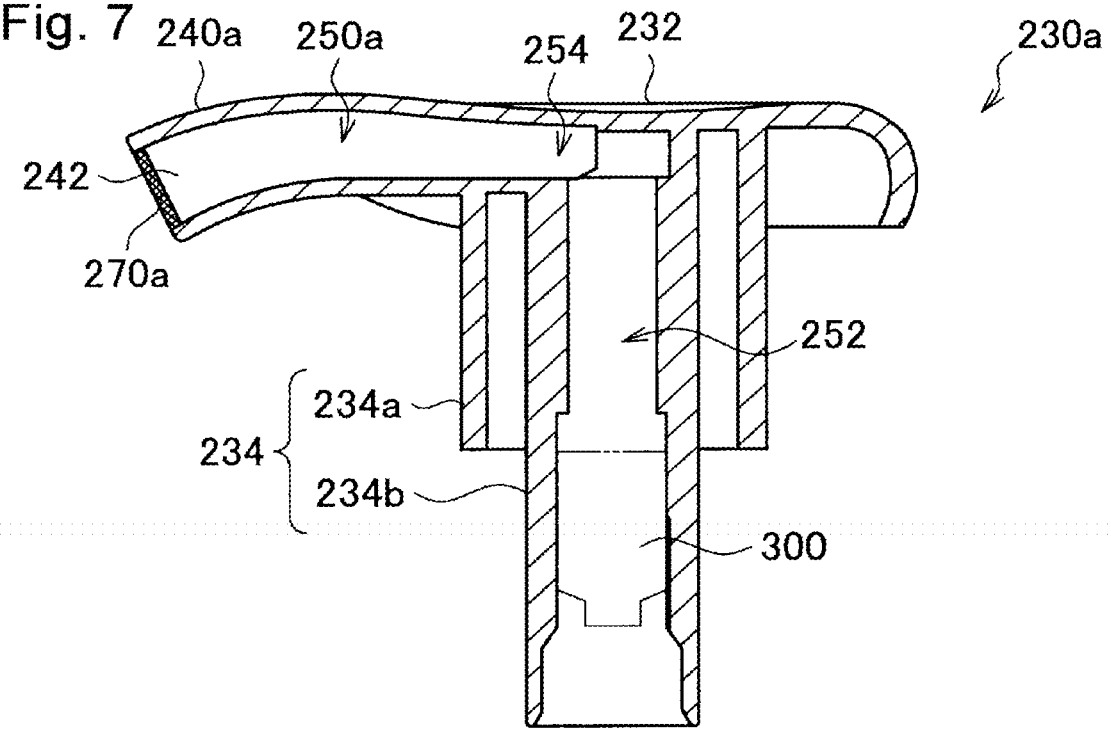
FIG. 7 is an explanatory diagram illustrating a sectional side view of the head portion 230*a* according to the second embodiment of the invention.
Figure 8:
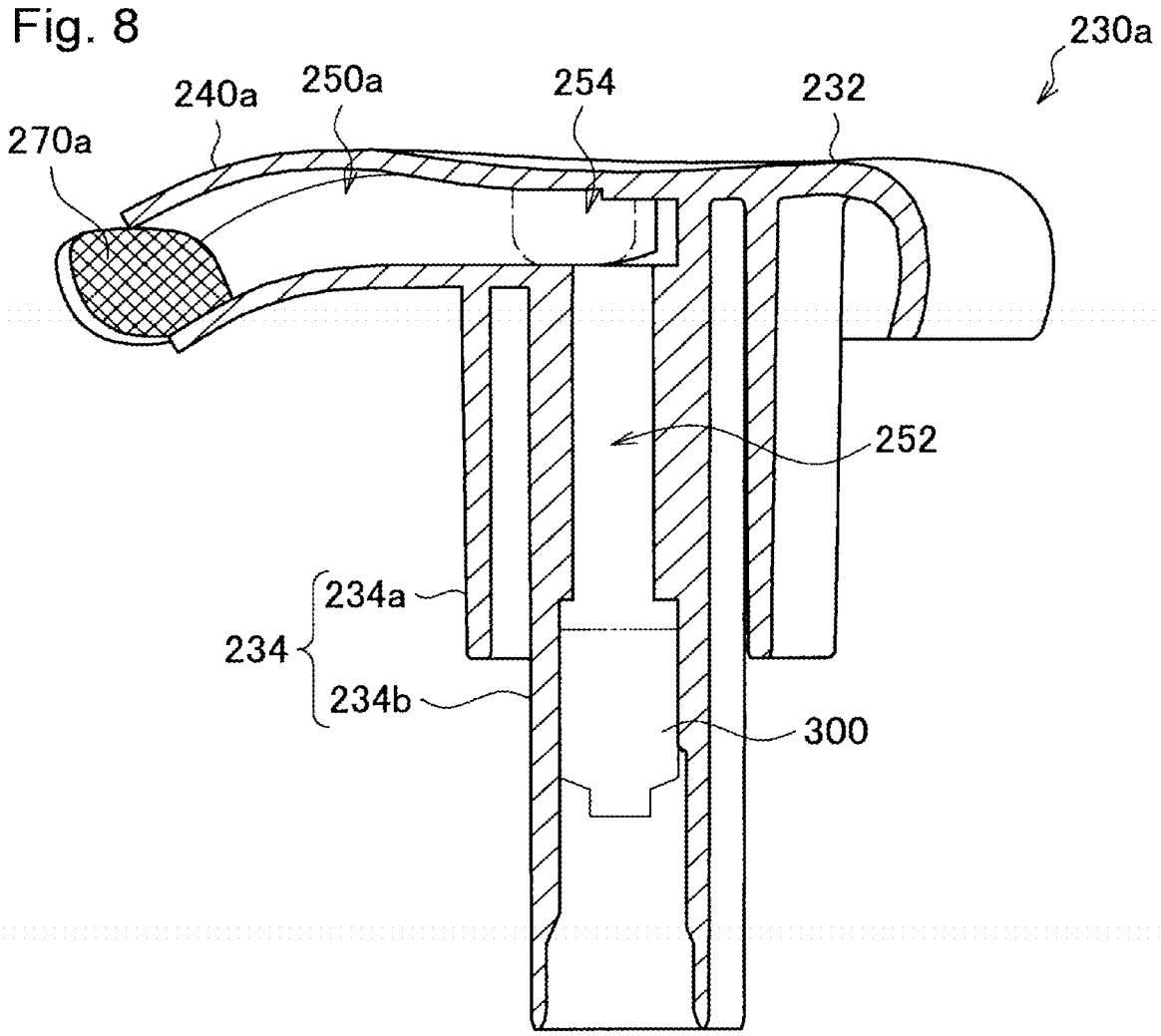
FIG. 8 is a perspective view of the side section illustrated in FIG. 7.

A detailed configuration of the head portion 230*a* according to the present embodiment will be described below with reference to FIGS. 6 to 8. FIG. 6 is an explanatory diagram illustrating an appearance of the head portion 230*a* according to the present embodiment. FIG. 7 is an explanatory diagram illustrating a sectional side view of the head portion 230*a* according to the present embodiment, and more specifically, illustrates a side section of the head portion 230*a* of FIG. 6, cut along the center axis of the foam-discharging container 10. FIG. 8 is a perspective view of the side section illustrated in FIG. 7, and is a diagram of the side section of the head portion 230*a* illustrated in FIG. 7, rotated about the center axis. FIG. 8 illustrates a porous element 270*a* in a non-cut state.

As in the first embodiment, as illustrated in FIG. 6, the head portion 230*a* of the present embodiment mainly includes: a nozzle portion 240*a* having a discharge opening 242 configured to discharge a foamed liquid agent; an operation portion 232 configured to receive pressing operation by the fingers etc. of a user; and a cylindrical portion 234 (outer cylindrical portion 234*a*; inner cylindrical portion 234*b*) that hangs downward from the operation portion 232. In the present embodiment, the shape/configuration of the nozzle portion 240*a* is different from that in the first embodiment. Stated differently, in the present embodiment, the operation portion 232 and the cylindrical portion 234 are substantially the same as in the first embodiment. So, the following description will focus on the shape/configuration of the nozzle portion 240*a*, which is different from the first embodiment, and detailed explanation of the operation portion 232 and the cylindrical portion 234 will be omitted.

As illustrated in FIG. 7, also in the present embodiment, a foam flow path 250*a* through which the foamed liquid agent passes is provided in the interior of the nozzle portion 240*a*. As in the first embodiment, the inner diameter of the foam flow path 250*a* gradually increases toward the discharge opening 242 from a connecting portion 254 where the foam flow path and a communication flow path 252 are connected. Note, however, that in the present embodiment, the degree of increase in the diameter of the foam flow path 250*a* may be smaller than in the first embodiment.

Further, as illustrated in FIG. 7, in the present embodiment, a porous element 270*a* is provided directly to the discharge opening 242 so as to close off the discharge opening 242 at the tip end of the nozzle portion 240*a*. Like the porous element 270 of the first embodiment, the porous element 270*a* is capable of making the liquid agent into a finer foam by causing the foamed liquid agent supplied from the foamer mechanism 300 to pass therethrough.

Further, as illustrated in FIG. 8, also in the present embodiment, the cross-sectional area of the foam flow path 250*a* on a cross section orthogonal to the supply direction in which the foamed liquid agent is to be supplied gradually increases along the supply direction of the foamed liquid agent from the connecting portion 254 toward the discharge opening 242. More specifically, the cross-sectional area of the foam flow path 250*a* at the discharge opening 242 is preferably at least 1.2 times the cross-sectional area (minimum cross-sectional area) of the foam flow path 250 at the connecting portion 254. Further, in the present embodiment, the cross-sectional area of the porous element 270*a* (more specifically, the cross-sectional area on a cross section orthogonal to the supply direction) is preferably at least 1.2 times the minimum cross-sectional area.

The present embodiment differs from the first embodiment in that the porous element 270*a* is provided directly to the discharge opening 242 without using a porous fitting member 272. Thus, the present embodiment can suppress reduction in the cross-sectional area of the porous element 270*a* due to, for example, the thickness of the porous fitting member 272. Thus, the cross-sectional area of the porous element 270*a* can be further increased, even if the degree of increase in the diameter of the foam flow path 250*a* is small. As a result, the present embodiment can reduce the flow velocity when the foamed liquid agent passes through the porous element 270*a*, even if the degree of increase in the diameter of the foam flow path 250*a* is small. Stated differently, the present embodiment can also provide a foam-discharging container 10 capable of discharging a fine liquid agent foam with further improved uniformity.

Third Embodiment

A foam-discharging cap 200 according to an embodiment of the invention may have a different shape/configuration from that of the foregoing first and second embodiments. Below, a foam-discharging cap 200*b* having a different shape/configuration will be described in detail as a foam-discharging cap according to a third embodiment of the invention.

Foam-Discharging Cap 200*b:*

Figure 9:
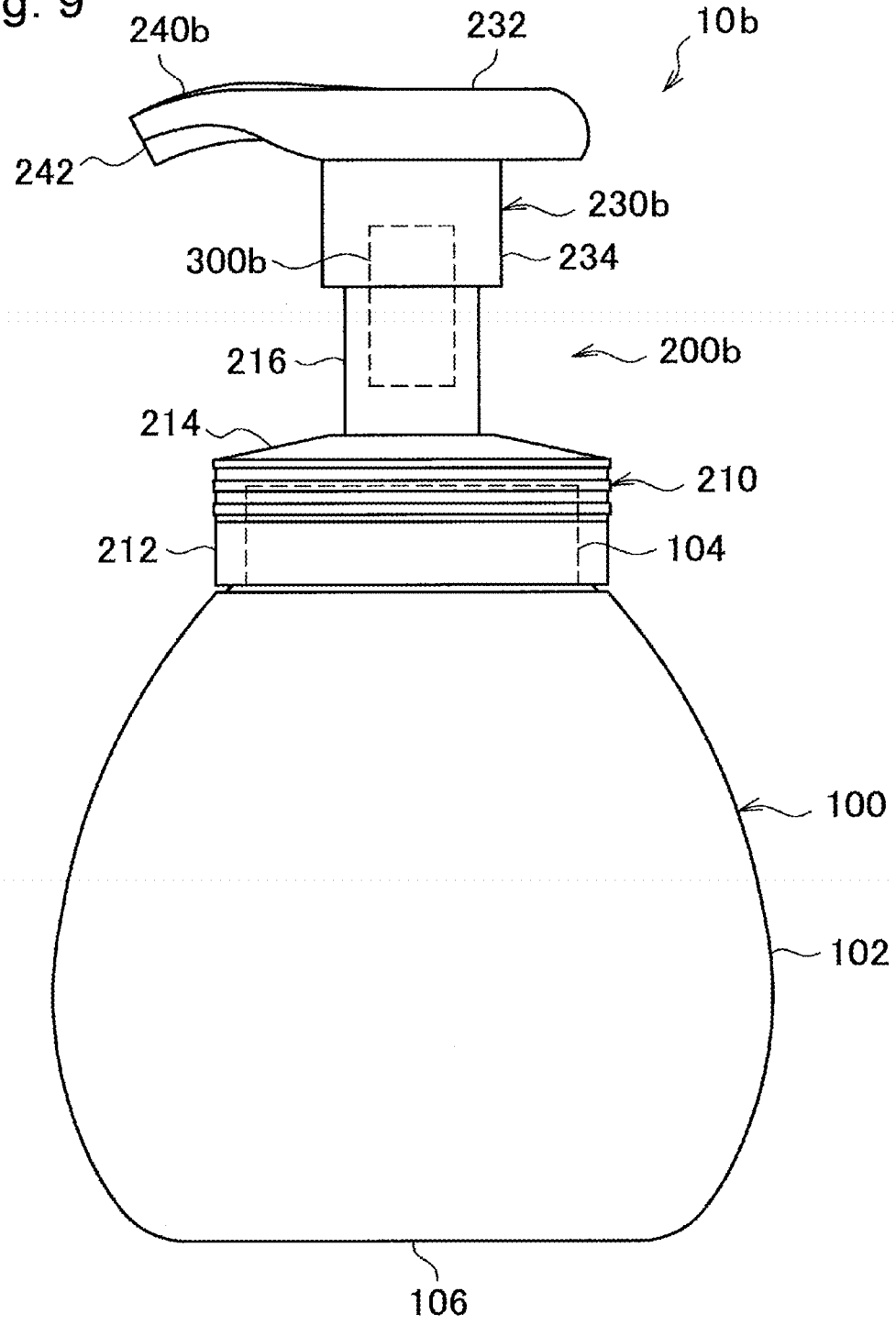
FIG. 9 is an explanatory diagram illustrating an appearance of a foam-discharging container 10 according to a third embodiment of the invention.

FIG. 9 illustrates a foam-discharging container 10*b* according to a third embodiment. The foam-discharging container 10*b* includes a foam-discharging cap 200*b*. As illustrated in FIG. 9, the foam-discharging cap 200*b* is a foam-discharging cap 200*b* that is configured to be attached to a container body 100 for storing a liquid agent and supported by the container body 100 thereabove. The foam-discharging cap 200*b* can be detachably attached to a neck portion 104 of the container body 100 by a fastening method such as screwing. The foam-discharging cap 200*b* mainly includes: a cap member 210 configured to be attached to the neck portion 104; a cylinder portion 220 (see FIG. 10) fixed to the cap member 210 and configuring a later-described liquid-agent supplying portion and gas supplying portion; and a head portion 230*b* configured to discharge a foamed liquid agent to outside the foam-discharging container 10*b*.

More specifically, the cap member 210 has a cylindrical attachment portion 212, and by, for example, screwing the attachment portion 212 onto the neck portion 104, the whole foam-discharging cap 200*b* can be attached to the container body 100. Stated differently, by attaching the foam-discharging cap 200*b* onto the neck portion 104, the foam-discharging cap 200*b* closes the opening in the neck portion 104. The attachment portion 212 may be formed with a double-cylinder structure; in this case, the inner cylinder of the attachment portion 212 will be attached—e.g. screwed—onto the neck portion 104. Further, the cap member 210 includes: an annular closing portion 214 that closes an upper end portion of the attachment portion 212; and an upright tube portion 216 that rises upward from a central portion of the annular closing portion 214 (i.e., a central portion in a planar view of the annular closing portion 214). The upright tube portion 216 has a circular-cylindrical shape having a smaller diameter than the attachment portion 212. A portion of the cylinder portion 220 (described below) is inserted within the upright tube portion 216.

The cylinder portion 220 (see FIG. 10) includes: a foamer mechanism (mixing portion) 300*b* configured to mix a liquid agent and a gas and transform the liquid agent into a foam; a liquid-agent supplying portion for supplying the liquid agent stored in the container body 100 to the foamer mechanism 300*b*; and a gas supplying portion for taking in a gas from outside the foam-discharging container 10*b* and supplying the gas to the foamer mechanism 300*b*. More specifically, the liquid-agent supplying portion is, for example, a liquid-agent cylinder constituting a liquid-agent pump, and is configured to pressurize the liquid agent inside a later-described liquid-agent pump chamber 280 (see FIG. 10) and supply the liquid agent to the foamer mechanism 300*b*. The gas supplying portion is, for example, a gas cylinder constituting a gas pump, and is configured to pressurize a gas inside a later-described gas pump chamber 261 (see FIG. 10) and supply the gas to the foamer mechanism 300*b*. The liquid-agent supplying portion, the gas supplying portion, and the foamer mechanism 300*b* will be described in detail further below with reference to other figures. The upper end of the cylinder portion 220 is closed by the later-described head portion 230*b*.

Note that, hereinbelow, the "gas" to be mixed with the liquid agent in the foamer mechanism 300*b* refers to air (outside air) that is taken in from outside the foam-discharging container 10*b* and that contains nitrogen, oxygen, carbon dioxide, etc. In the present embodiment, however, the gas is not limited to air, and may be, for example, a gas containing various gaseous components and stored in advance in the foam-discharging container 10*b*'s container body 100 etc.

As illustrated in FIG. 9, the head portion 230*b* includes a nozzle portion 240*b* provided as an integral object with the head portion 230*b*. A discharge opening 242 is provided at the tip end of the nozzle portion 240*b*. The interior space of the nozzle portion 240*b* is in communication with the foamer mechanism 300*b*, and therefore, the liquid agent foamed in the foamer mechanism 300*b* can be discharged from the discharge opening 242 to outside the foam-discharging container 10*b*. The head portion 230*b* also includes a cylindrical portion 234 that hangs downward from an operation portion 232.

The head portion 230*b* is configured so as to be movable vertically (up and down). More specifically, the head portion 230*b* includes an operation portion 232 configured to receive pressing operation by the fingers etc. of a user. Further, as illustrated in FIG. 9, the nozzle portion 240*b* is provided so as to project from the operation portion 232. More specifically, in a case where the operation portion 232 is subjected to pressing operation by a user and the head portion 230*b* is pressed down relatively to the attachment portion 212, the liquid-agent supplying portion pressurizes the liquid agent inside the liquid-agent pump chamber 280 (see FIG. 10) and supplies the liquid agent to the foamer mechanism 300*b*, and also in the aforementioned case, the gas supplying portion pressurizes the gas inside the gas pump chamber 261 (see FIG. 10) and supplies the gas to the foamer mechanism 300*b*.

Detailed Configuration of Foam-Discharging Cap 200*b:*

Figure 10:
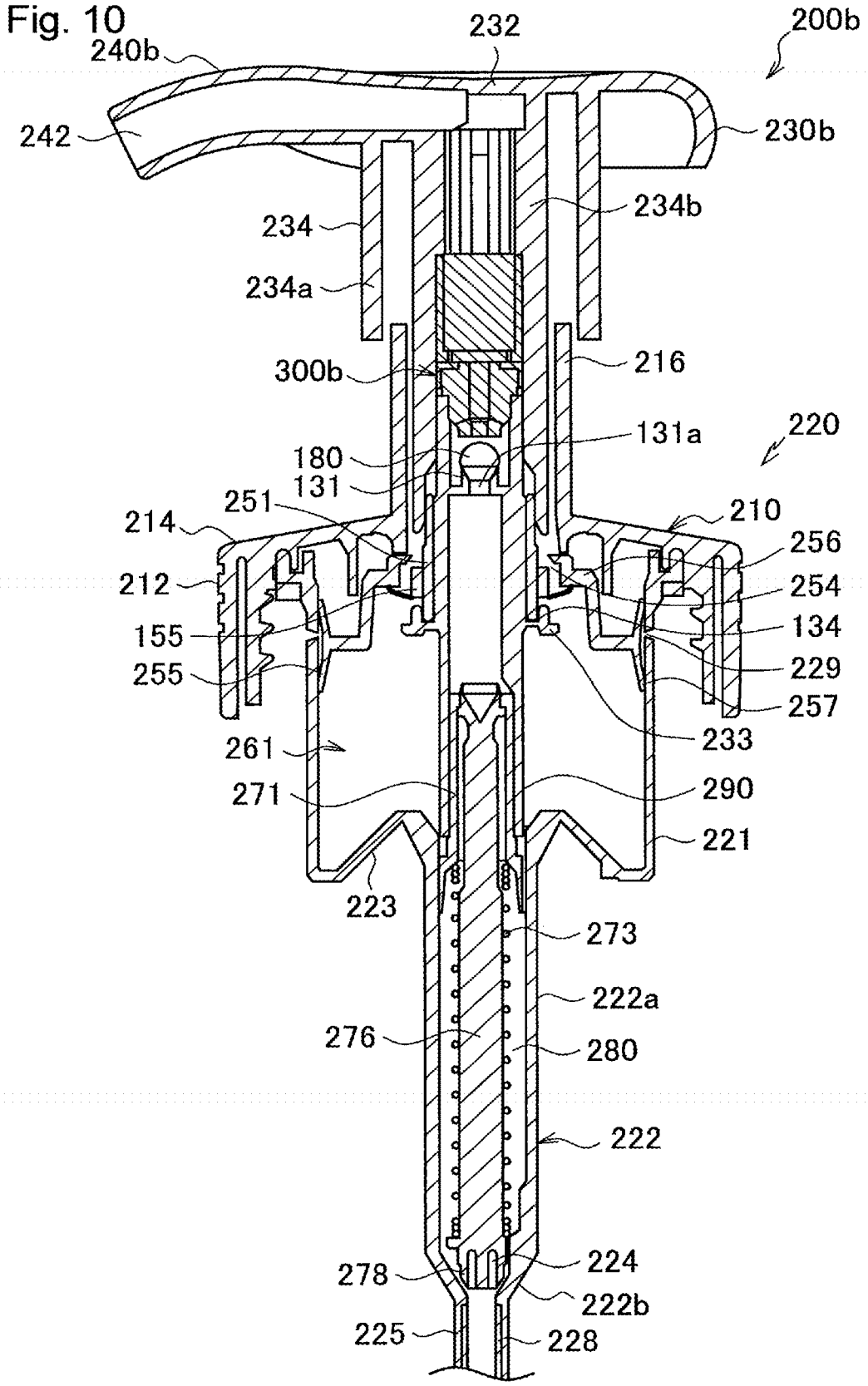
FIG. 10 is a sectional side view of a foam-discharging cap 200*b* according to the third embodiment of the invention.

Next, a detailed configuration of the foam-discharging cap 200*b* will be described with reference to FIG. 10. FIG. 10 is a sectional side view of the foam-discharging cap 200*b* according to this embodiment of the invention. As described above, the foam-discharging cap 200*b* of the present embodiment mainly includes the head portion 230*b*, the cylinder portion 220, and the cap member 210. Further, the foam-discharging cap 200*b* includes a piston guide 290 as illustrated in FIG. 10. Detailed configurations of the various parts of the foam-discharging cap 200*b* will be described below.

Head Portion 230*b:*

As described above, the head portion 230*b* includes the operation portion 232 and the cylindrical portion 234 hanging downward from the operation portion 232. More specifically, the cylindrical portion 234 is indirectly supported by the cylinder portion 220, a later-described piston guide 290, a coil spring 273, etc. The head portion 230*b* can be pressed down (lowered) within a predetermined range against the biasing force from the coil spring 273. More specifically, in a state where the pressing operation is released, the head portion 230*b* ascends relatively to the cap member 210 along the up-down direction, in accordance with the bias of the coil spring 273, and moves to the upper stop point. On the other hand, by the pressing operation applied by the user to the head portion 230*b* (more specifically, the operation portion 232) against the bias from the coil spring 273, the head portion 230*b* descends relatively to the cap member 210. As illustrated in FIG. 10, the cylindrical portion 234 has a double-cylinder structure, and includes an outer cylindrical portion 234*a* and an inner cylindrical portion 234*b*. When the head portion 230*b* moves up and down, the head portion can move along the up-down direction while securing a narrow flow path (not illustrated) that allows intake of air between the cap member 210's upright tube portion 216 and the inner cylindrical portion 234*b* and inner cylindrical portion 234*b*.

Foamer Mechanism 300*b*:

As described above, the foamer mechanism 300*b* is a mechanism for mixing a liquid agent and a gas to thereby transform the liquid agent into a foam. As illustrated in FIG. 10, the foamer mechanism is housed in the inner cylindrical portion 234*b* of the cylindrical portion 234. The upper side of the foamer mechanism 300*b* is in communication with the interior space of the nozzle portion 240*b* of the head portion 230*b*. Thus, the liquid agent foamed in the foamer mechanism 300*b* can be discharged to outside the foam-discharging container 10*b* through the discharge opening 242 of the nozzle portion 240*b*. The lower side of the foamer mechanism 300*b* opposes a check valve that is constituted by a ball valve 180 and a valve seat portion 131 provided inside the later-described piston guide 290, and that permits liquid to be supplied to the foamer mechanism 300*b*. The foamer mechanism 300*b* according to this embodiment of the invention will be described in detail further below.

Piston Guide 290:

The piston guide 290 is a cylindrical member that is located below the foamer mechanism 300*b* and that is long in the up-down direction, and is fixed to the head portion 230*b*. A later-described liquid piston 271 is fixed to the head portion 230*b* by means of the piston guide 290. The head portion 230*b*, the piston guide 290, and the liquid piston 271 are integrally movable along the up-down direction. The valve seat portion 131 is formed in the upper interior of the piston guide 290, and the ball valve 180 is arranged on the valve seat portion 131. The ball valve 180 is retained so as to be movable vertically (up and down) between the lower end of the foamer mechanism 300*b* and the valve seat portion 131. A through hole 131*a* in communication with the lower side of the valve seat portion 131 is provided in the center of the valve seat portion 131. More specifically, the ball valve 180 and the valve seat portion 131 constitute the aforementioned check valve; the up-down movement of the ball valve 180 allows the check valve to supply the liquid agent to the foamer mechanism 300*b* from below the valve seat portion 131, and to inhibit the liquid from returning from the foamer mechanism 300 to the liquid-agent supplying portion.

The piston guide 290 is fitted outside a later-described gas piston 255 in a manner that there is play therebetween, and the gas piston 255 can move along the up-down direction relatively to the piston guide 290. A flange 233 is provided in a central portion, in the up-down direction, of the piston guide 290. A ring-shaped (donut-shaped) valve-constituting groove 134 is formed in the upper surface of the flange 233. A cylindrical portion 251 of the later-described gas piston 255 is fitted outside the upper portion of the piston guide 290 in a manner that there is play therebetween. The valve-constituting groove 134 and a lower end portion of the cylindrical portion 251 of the gas piston 255 constitute a gas emission valve. More specifically, a plurality of flow path-constituting grooves (not illustrated), each extending along the up-down direction, are provided in the outer circumferential surface of the piston guide 290 in a section onto which the cylindrical portion 251 is fitted. Gaps (not illustrated) are formed between these flow path-constituting grooves and the inner circumferential surface of the cylindrical portion 251 of the gas piston 255, and these gaps constitute gas flow paths through which a gas, which exits from the later-described gas pump chamber 261, flows upward via the aforementioned gas emission valve.

Liquid-Agent Supplying Portion and Gas Supplying Portion:

As illustrated in FIG. 10, the foam-discharging cap 200*b* of the present embodiment has the aforementioned liquid-agent supplying portion and gas supplying portion provided inside the cap member 210 and cylinder portion 220. More specifically, the cylinder portion 220 includes, as the aforementioned gas supplying portion, a cylindrical gas cylinder mechanism 221 fixed to the lower surface side of the annular closing portion 214 of the cap member 210. The cylinder portion 220 also includes, as the aforementioned liquid-agent supplying portion, a liquid-agent cylinder mechanism 222 that has a cylindrical shape with a smaller diameter than the gas cylinder mechanism 221 and that is provided so as to hand down from the gas cylinder mechanism 221. The cylinder portion 220 also includes an annular connecting portion 223 that connects the lower end of the gas cylinder mechanism 221 and the upper end of the liquid-agent cylinder mechanism 222.

Gas Cylinder Mechanism 221:

The upper end portion of the gas cylinder mechanism 221 is fitted onto the lower surface side of the annular closing portion 214 and is thereby fixed to the annular closing portion 214. The gas cylinder mechanism 221 includes a gas piston 255. Hereinbelow, in the gas cylinder mechanism 221, a space between the gas piston 255 and the annular connecting portion 223 is referred to as a gas pump chamber 261. The gas pump chamber 261 is capable of storing a gas. The volume of the gas pump chamber 261 is expandable/contractible in accordance with the up/down movement of the gas piston 255.

The gas piston 255 is formed in a cylindrical shape. The gas piston 255 includes: a cylindrical portion 251 that is fitted on the outside of a central portion, in the up-down direction, of the piston guide 290 in a manner that there is play therebetween; and a piston portion 256 that projects radially outward from the cylindrical portion 251. An outer circumferential ring portion 253 is provided to the peripheral edge of the piston portion 256. The outer circumferential ring portion 253 circumferentially contacts the inner circumferential surface of the gas cylinder mechanism 221 in a gas-tight manner, and can slide along the inner circumferential surface of the gas cylinder mechanism 221 when the gas piston 255 moves up and down. A plurality of intake openings 257 penetrating the piston portion 256 along the up-down direction are provided in a section of the piston portion 256 near the cylindrical portion 251.

More specifically, pressing operation of the head portion 230*b* by a user causes the gas pump chamber 261 to contract. At this time, the gas inside the gas pump chamber 261 is pressurized and the gas piston 255 slightly rises relative to the piston guide 290, which thereby opens the gas emission valve constituted by the cylindrical portion 251 and the valve-constituting groove 134. As a result, the gas inside the gas pump chamber 261 is sent upward through the gas emission valve and the gas flow paths (not illustrated) provided between the cylindrical portion 251 and the piston guide 290. Further, above the cylindrical portion 251 of the gas piston 255, a gas flow path (not illustrated) is formed by a gap between the inner circumferential surface of the lower end portion of the cylindrical portion 234 and the outer circumferential surface of the piston guide 290. This gas flow path is in communication with the gas flow paths provided between the cylindrical portion 251 and the piston guide 290; thus, the gas inside the gas pump chamber 261 can be supplied to the foamer mechanism 300*b* through the gas emission valve, the gas flow paths provided between the cylindrical portion 251 and the piston guide 290, and the gas flow path provided between the inner circumferential surface of the lower end portion of the cylindrical portion 234 and the outer circumferential surface of the piston guide 290.

A ring-shaped intake valve member 155 is fitted onto the lower side of the cylindrical portion 251 of the gas piston 255. The intake valve member 155 includes a valve body which is an annular membrane projecting radially outward. The valve body of the intake valve member 155 and the piston portion 256 constitute a gas intake valve. More specifically, when the head portion 230*b* is lowered—i.e., when the gas pump chamber 261 contracts—the valve body of the intake valve member 155 is in tight contact with the piston portion 256, and thereby the intake openings 257 are closed. On the other hand, when the head portion 230*b* is raised—i.e., when the gas pump chamber 261 expands the pressure inside the gas pump chamber 261 drops, and thereby the valve body of the intake valve member 155 separates from the piston portion 256 and the intake openings 257 are thus opened. Thus, gas outside the foam-discharging container 10*b* can be taken into the gas pump chamber 261 through a gap located between the upper end of the upright tube portion 216 and the cylindrical portion 234.

Further, through holes 229 penetrating the gas cylinder mechanism 221, thereby connecting the inside and outside thereof, are formed in the gas cylinder mechanism 221. In a state where the head portion 230*b* is not pressed down and the head portion 230*b* is resting at an upward position, the through holes 229 are closed by the outer circumferential ring portion 253 of the gas piston 255. When the head portion 230*b* is pressed down and thereby the through holes 229 transition from a state where they are closed by the outer circumferential ring portion 253 to a non-closed state, gas outside the foam-discharging container 10*b* flows into the container body 100 through the gap located between the upper end of the upright tube portion 216 and the cylindrical portion 234, and the through holes 229. This inflow of gas makes the pressure of the space (gas) located above the liquid surface of the liquid agent inside the container body 100 equal to atmospheric pressure.

Liquid-Agent Cylinder Mechanism 222:

The liquid-agent cylinder mechanism 222 includes a liquid piston 271. Hereinbelow, in the liquid-agent cylinder mechanism 222, a space provided between the check valve, which is constituted by the ball valve 180 and the valve seat portion 131, and a later-described liquid-agent intake valve is referred to as a liquid-agent pump chamber 280. The liquid-agent pump chamber 280 is capable of storing a liquid agent. The volume of the liquid-agent pump chamber 280 is expandable/contractible in accordance with the up/down movement of the liquid piston 271 and the piston guide 290. More specifically, pressing operation of the head portion 230*b* by a user causes the liquid-agent pump chamber 280 to contract. At this time, the liquid agent inside the liquid-agent pump chamber 280 is pressurized, which thereby opens the check valve constituted by the ball valve 180 and the valve seat portion 131 and allows the liquid agent in the liquid-agent pump chamber 280 to be supplied to the foamer mechanism 300*b* through the check valve.

The liquid piston 271 has a cylindrical (tubular) shape. The lower end portion of the piston guide 290 is inserted in the upper end portion of the liquid piston 271. In this way, the liquid piston 271 can be fixed to the piston guide 290. A straight portion 222*a* of the liquid-agent cylinder mechanism 222 is provided below the lower end of the liquid piston 271.

As illustrated in FIG. 10, the liquid-agent cylinder mechanism 222 also includes a poppet 276 which is a rod-shaped member extending along the up-down direction. The poppet 276 penetrates the liquid piston 271 and extends through the interior of the piston guide 290 and the interior of the liquid-agent cylinder mechanism 222. The poppet 276 is movable along the up-down direction relatively to the liquid piston 271. A lower end portion of the poppet 276 constitutes a valve body portion 278. The lower surface of the valve body portion 278 is capable of contacting a later-described valve seat portion 224 in a liquid-tight fashion. The valve body portion 278 and the valve seat portion 224 constitute a liquid-agent intake valve.

The liquid-agent cylinder mechanism 222 further includes a coil spring 273. The coil spring 273 is fitted on the outside of an intermediate section of the poppet 276 (more specifically, an intermediate section in the up-down direction) in a manner that there is play therebetween. The coil spring 273 is, for example, a compression coil spring, and is retained in a compressed state. Thus, the coil spring 273 is capable of upwardly biasing the liquid piston 271, the piston guide 290, and the head portion 230*b*.

The liquid-agent cylinder mechanism 222 further includes: a straight portion 222*a* having a straight shape extending along the up-down direction; and a tapered portion 222*b* that is connected below the straight portion 222*a* and that is tapered downward. The valve seat portion 224 to be paired with the valve body portion 278 is provided to a lower portion in the inner circumferential surface of the tapered portion 222*b*. The tapered portion 222*b* has a cylindrical tube-retaining portion 225 connected below the tapered portion 222*b*. An upper end portion of a dip tube 228 is inserted into the tube-retaining portion 225, and thereby, the dip tube 228 is retained by the lower end portion of the cylinder portion 220. In this way, the liquid agent in the container body 100 will be sucked into the liquid-agent pump chamber 280 through the dip tube 228.

More specifically, when the head portion 230*b* is pressed down by a user and the piston guide 290 descends, the poppet 276 follows the movement of the piston guide 290 due to friction between the piston guide 290 and an upper end portion of the poppet 276, and thereby, the lower surface of the valve body portion 278 of the poppet 276 contacts the valve seat portion 224 of the cylinder portion 220 in a liquid-tight manner. When the pressing operation to the head portion 230*b* by the user is released, the liquid piston 271, the piston guide 290, and the head portion 230*b* rise in accordance with the bias of the coil spring 273. As a result, the valve body portion 278 of the poppet 276 slightly rises at a gap between the lower end of the coil spring 273 and the valve seat portion 224, and thereby, the liquid-agent intake valve at the lower end portion of the liquid-agent pump chamber 280 opens along with the rise of the valve body portion 278, and the liquid agent is sucked into the liquid-agent pump chamber 280 through the liquid-agent intake valve.

It should be noted that, in the present embodiment, the configuration of the liquid-agent supplying portion and the gas supplying portion is not particularly limited to the configuration described above, and various known configurations are applicable.

Configuration of Foamer Mechanism 300*b*:

Next, a configuration of the foamer mechanism 300*b* according to the present embodiment will be described with reference to FIGS. 3 to 13. FIG. 3 is a perspective view of the foamer mechanism 300*b* according to the present embodiment. FIG. 4 is an exploded perspective view of the foamer mechanism 300*b* according to the present embodiment. FIG. 13 is a perspective sectional view of the foamer mechanism 300*b* according to the present embodiment, and more specifically, is perspective view of a cross section of the foamer mechanism 300*b* cut along the up-down direction so as to pass through the center axis of the foamer mechanism 300*b*.

Figure 11:
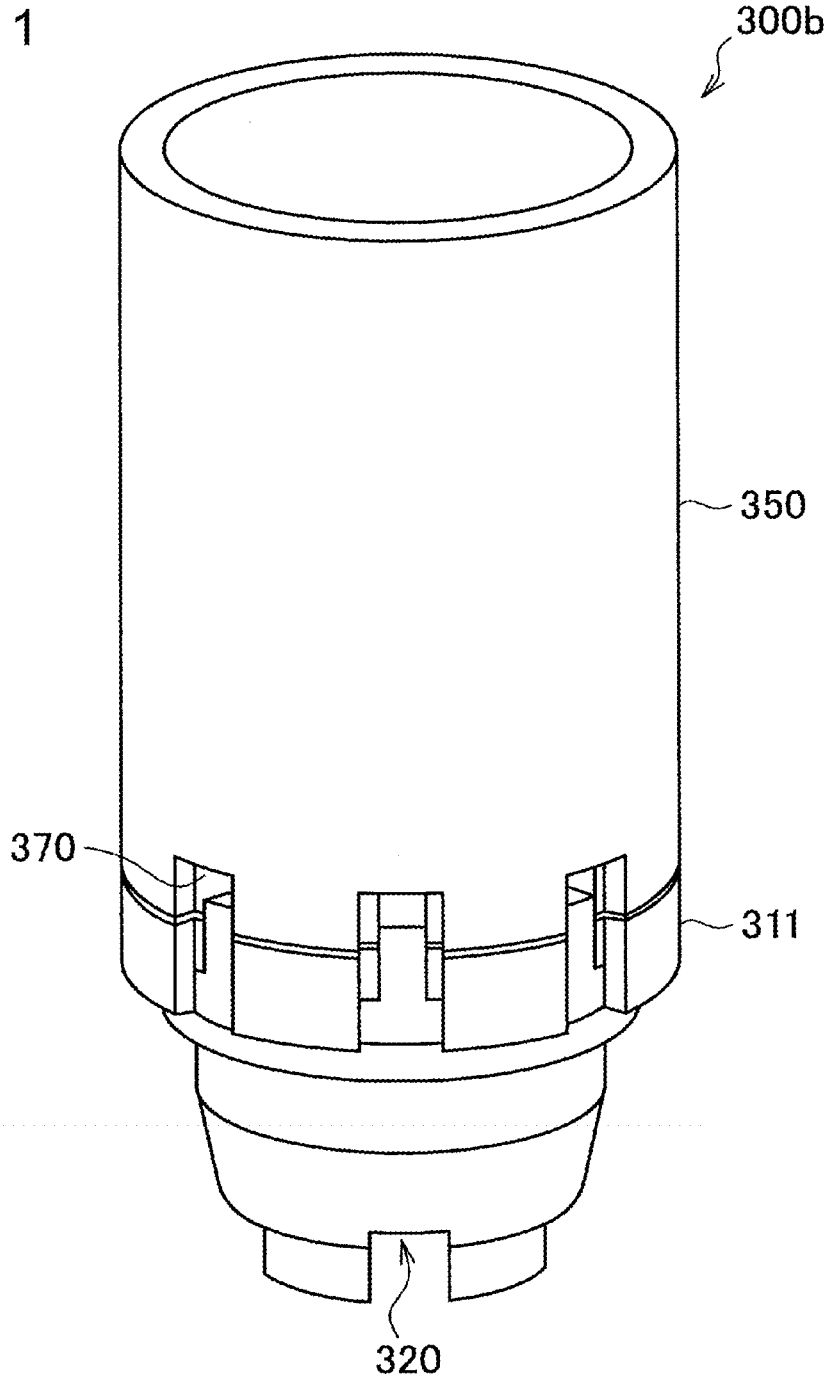
FIG. 11 is a perspective view of a foamer mechanism 300*b* according to the third embodiment of the invention.
Figure 12:
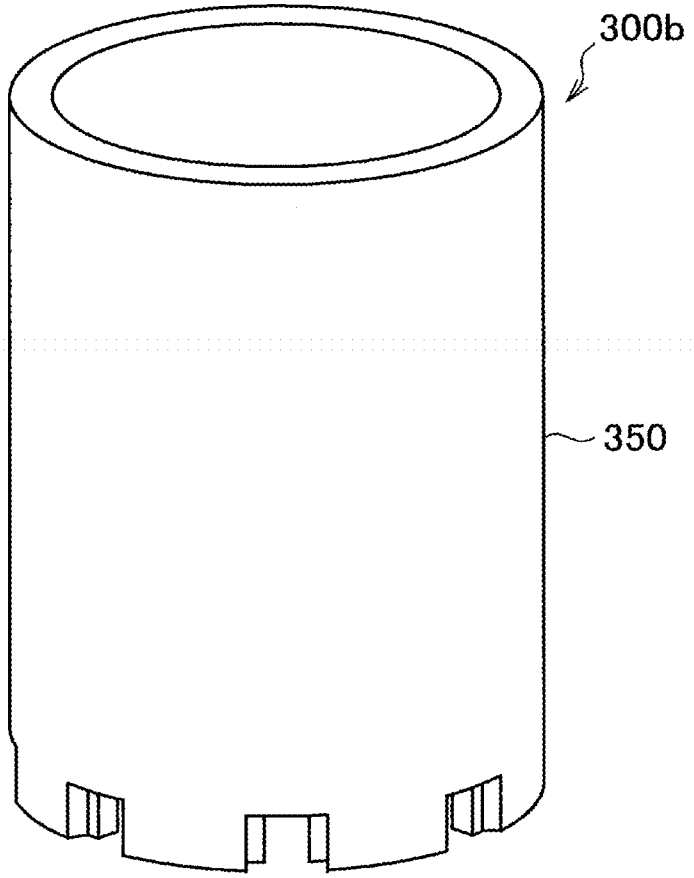
FIG. 12 is an exploded perspective view of the foamer mechanism 300*b* according to the third embodiment of the invention.
Figure 12:
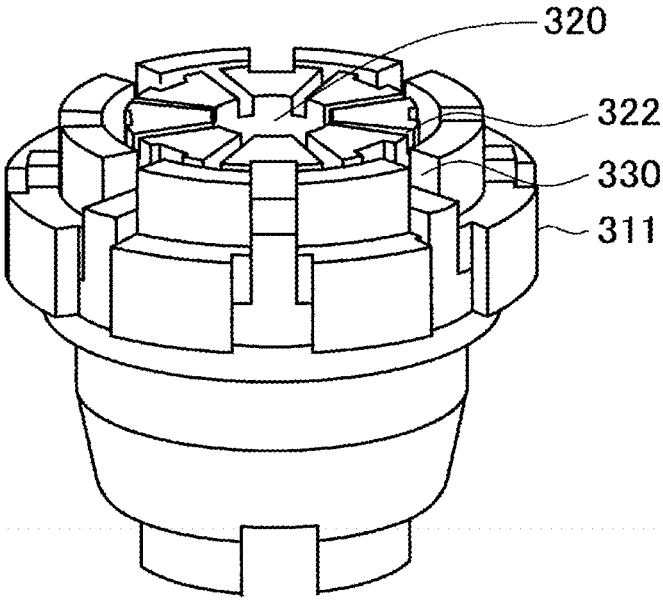
Figure 13:
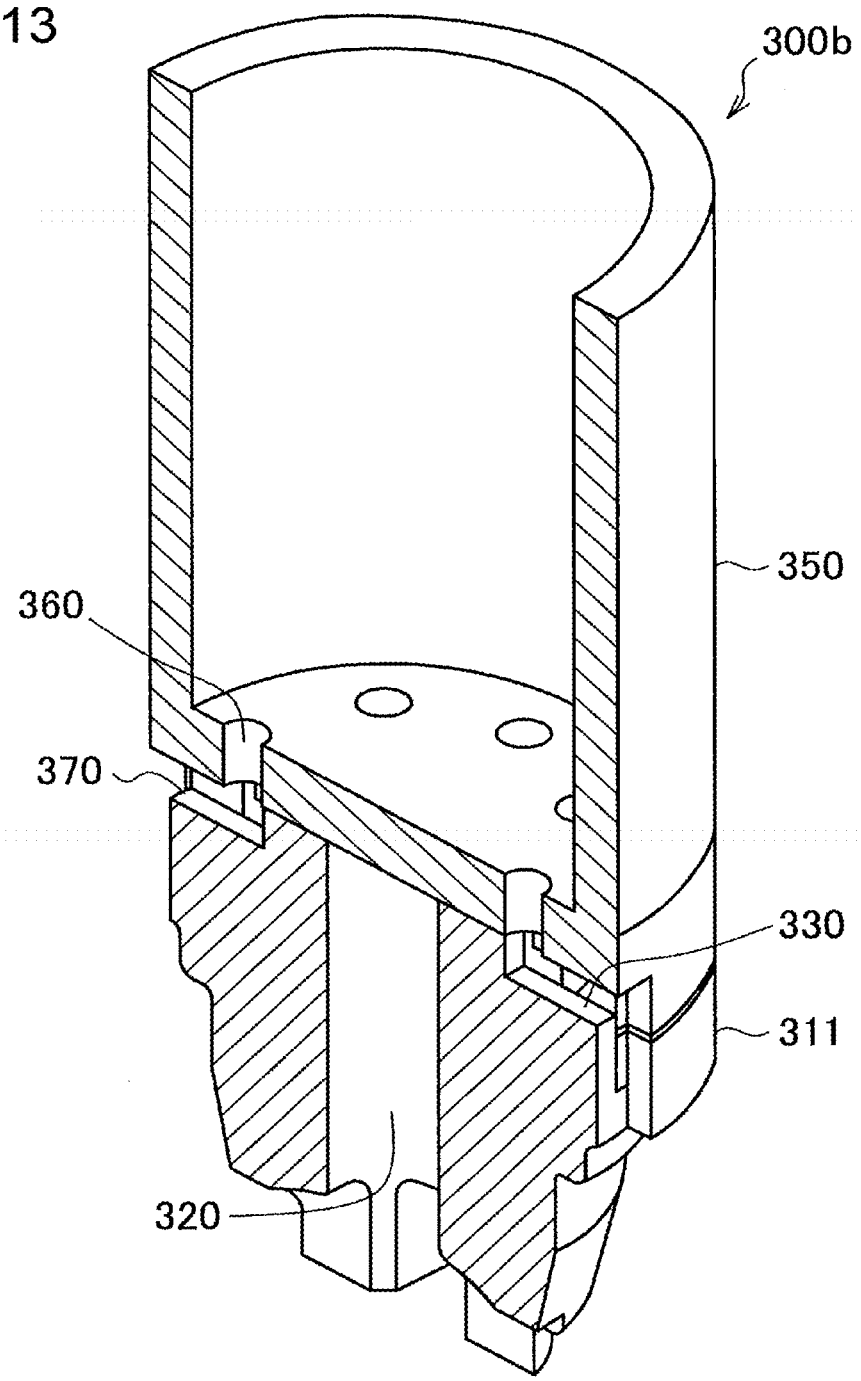
FIG. 13 is a perspective sectional view of the foamer mechanism 300*b* according to the third embodiment of the invention.

As illustrated in FIGS. 11 and 12, the foamer mechanism 300*b* according to the present embodiment is a combination of two members—i.e., includes, from below, a first member 311 and a second member 350. As illustrated in FIG. 12, the first member 311, which mainly constitutes the lower side of the foamer mechanism 300*b*, is a member having a shape similar to a truncated circular cone (more specifically, a truncated circular cone is a geometrical figure that is created by cutting a circular cone along a plane parallel to the bottom surface, and eliminating the small circular cone portion therefrom), and more specifically, having a shape similar to a truncated circular cone wherein the circle with the larger diameter constitutes the upper surface. As illustrated in FIG. 12, the second member 350, which mainly constitutes the upper side of the foamer mechanism 300*b*, is a circular-cylindrical member.

More specifically, as illustrated in FIGS. 11 and 12, in the foamer mechanism 300*b*, a portion of the upper side of the first member 311 is inserted into the lower side of the circular-cylindrical second member 350. By this insertion, the second member 350 is supported on the first member 311. In the foamer mechanism 300*b*, in a planar view as viewed from above, the center axis penetrating the center of the first member 311 and the center axis penetrating the center of the second member 350 are coaxial.

As illustrated in FIG. 11, a plurality of (e.g., eight) intake openings 370, each configured to take in gas into the foamer mechanism 300*b*, are provided in the outer circumference of the foamer mechanism 300*b*. More specifically, each intake opening 370 is constituted by a gap that is present between the upper end of the outer circumference of the first member 311 and the lower end of the outer circumference of the second member 350 when the foamer mechanism 300*b* is assembled by inserting a portion of the upper side of the first member 311 into the lower side of the second member 350. The plurality of intake openings 370 are provided at equiangular intervals along the circumferential direction of the outer circumference of the foamer mechanism 300*b*.

As illustrated in FIG. 13, gas flow paths 330, which are in communication respectively with the intake openings 370, are provided in the upper surface of the first member 311. The gas supplied from the aforementioned gas cylinder mechanism 221 will be supplied to the gas flow paths 330 through the respective intake openings 370. Details of the gas flow paths 330 will be described further below in the detailed description of the first member 311.

As illustrated in FIG. 13, a liquid-agent flow path 320 is provided so as to penetrate a central portion (i.e., a central portion in a planar view of the first member 311) of the first member 311 along the up-down direction. The liquid agent supplied from the aforementioned liquid-agent cylinder mechanism 222 will be supplied to the liquid-agent flow path 320. The liquid-agent flow path 320 further supplies the liquid agent to liquid-agent flow paths 322 provided in the upper surface of the first member 311 as illustrated in FIG. 12. Details of the liquid-agent flow paths 322 will be described further below in the detailed description of the first member 311.

As illustrated in FIG. 13, a plurality of (e.g., eight) foam flow paths 360 are provided in the second member 350, which is provided above the first member 311, so as to penetrate the second member 350 along the up-down direction. The liquid agent and the gas supplied respectively by the liquid-agent flow paths 322 and the gas flow paths 330 are mixed together in the foamer mechanism 300*b* and made into a foamed liquid agent. The foamed liquid agent is then emitted to the upper surface side of the second member 350 through the foam flow paths 360 by being expelled by the liquid agent and gas supplied anew to the foamer mechanism 300*b*. The emitted foamed liquid agent is then discharged to outside the foam-discharging container 10*b* from the discharge opening 242 of the nozzle portion 240*b* of the cap member 210, as described above. Details of the foam flow paths 360 will be described further below in the detailed description of the second member 350.

Next, details of the various parts of the two members constituting the foamer mechanism 300*b* of the present embodiment—i.e., the first member 311 and the second member 350—will be described below.

Figure 14:
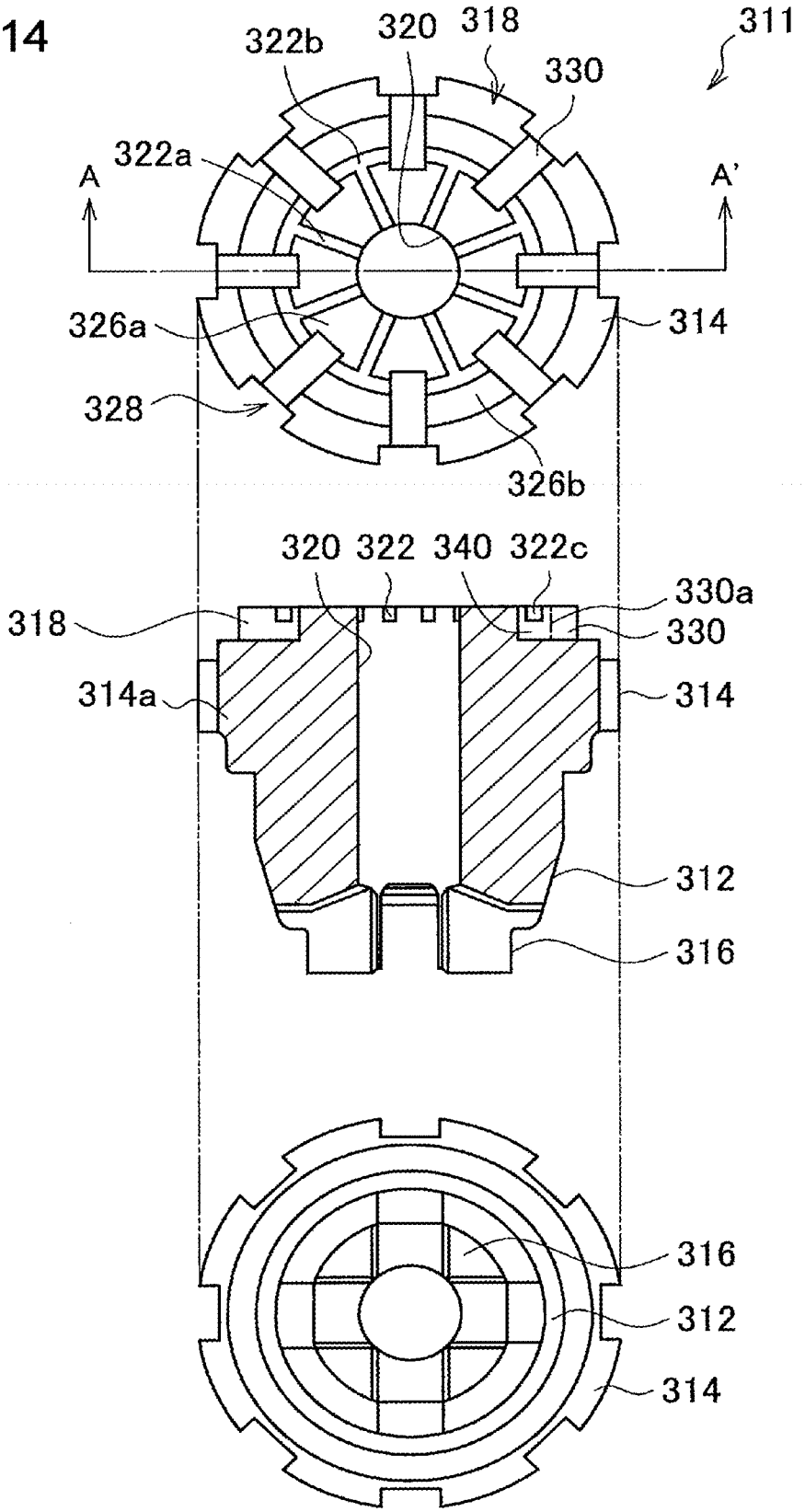
FIG. 14 illustrates explanatory diagrams of a first member 311 according to the third embodiment of the invention.
Figure 15:
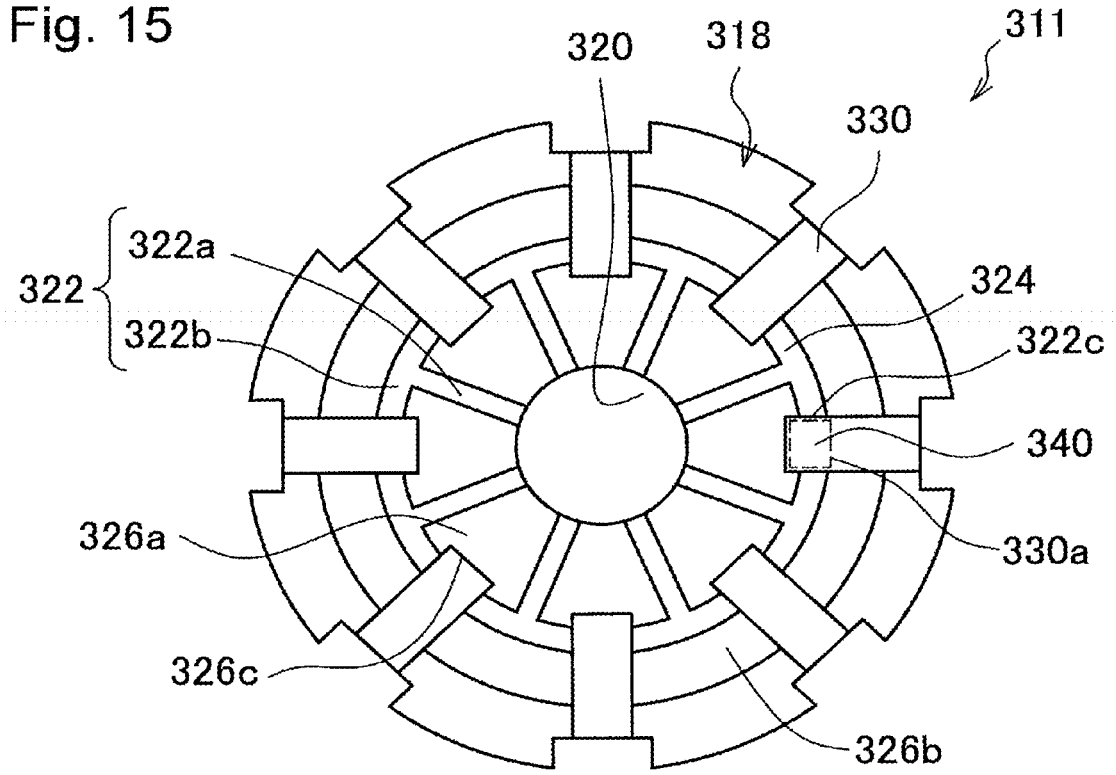
FIG. 15 is an explanatory diagram for illustrating liquid-agent flow paths 322 and gas flow paths 330 provided in the upper surface of the first member 311 according to the third embodiment of the invention.

First Member 311:

First, details of the first member 311 will be described with reference to FIGS. 14 and 15. FIG. 14 illustrates explanatory diagrams of the first member 311 according to the present embodiment, and more specifically, illustrates, from the top side of the figure, a top view of the first member 311, a cross-sectional view of the first member 311 cut along the up-down direction, and a bottom view of the first member 311. More specifically, the cross-sectional view corresponds to a cross section when the first member 311 is cut along line A-A' illustrated in the top view. FIG. 15 is an explanatory diagram for illustrating the liquid-agent flow paths 322 and the gas flow paths 330 provided in the upper surface of the first member 311 according to the present embodiment, and more specifically, is a top view of the first member 311.

As illustrated in FIG. 14, the first member 311 mainly includes: a cylindrical small-diameter portion 312; a cylindrical large-diameter portion 314 located above the small-diameter portion 312 and having a larger diameter than the small-diameter portion 312; and a plurality of (e.g., four) projections 316 projecting downward from the lower end of the small-diameter portion 312.

As illustrated in the cross-sectional view of the first member 311, the large-diameter portion 314 includes: a circular-cylindrical portion 314*a*; and a disk-shaped (circular plate-shaped; dish-shaped) slab portion 318 provided horizontally above the cylindrical portion 314*a*. As illustrated in the top view of the first member 311, an opening penetrating the slab portion 318 along the up-down direction is provided in a central portion of the slab portion 318 in a planar view thereof; this opening is in communication with the interior space of the cylindrical portion 314*a* and the interior space of the later-described small-diameter portion 312, to constitute the liquid-agent flow path 320. As illustrated in the top view of the first member 311, in a planar view of the slab portion 318, the upper surface of the slab portion 318 is provided with: a plurality of (e.g., eight) liquid-agent flow paths (first liquid-agent small flow paths) 322*a* extending radially from the liquid-agent flow path 320; and two liquid-agent flow paths (second liquid-agent small flow paths) 322*b* branching from each of the liquid-agent flow paths 322*a* and extending in a curved/bent manner therefrom. Also in the upper surface of the slab portion 318 are provided a plurality of (e.g., eight) gas flow paths 330 extending from the outer circumferential portion of the slab portion 318 toward the central portion thereof. The liquid-agent flow paths 322*a*, 322*b* and the gas flow paths 330 are constituted by gaps formed between flow path walls 326 as a result of the flow path walls 326 (more specifically, flow path walls 326*a*, 326*b*), which project upward from the upper surface of the slab portion 318, coming into contact with the lower surface of the second member 350 (more specifically, the lower surface of a slab portion 352) in a gas-tight (liquid-tight) manner.

More specifically, the liquid-agent flow path 320 provided in the central portion of the slab portion 318 will oppose the lower surface of the second member 350 (more specifically, the lower surface of the slab portion 352) in the up-down direction. Thus, the liquid agent fed through the liquid-agent flow path 320 will collide against the lower surface and will then flow along the in-plane direction (e.g., horizontal direction) of the upper surface of the slab portion 318. Stated differently, the lower surface of the second member 350 is capable of changing the flowing direction of the liquid agent from the up-down direction to the in-plane direction of the upper surface of the slab portion 318.

The upper surface of the slab portion 318 has a plurality of liquid-agent flow paths 322*a* extending so as to radially branch from the liquid-agent flow path 320. Stated differently, the liquid-agent flow paths 322*a* extend along the in-plane direction of the upper surface of the slab portion 318. The plurality of liquid-agent flow paths 322*a* are provided at equiangular intervals along the circumferential direction of the outer circumference of the slab portion 318. Further, in a planar view of the slab portion 318, two liquid-agent flow paths 322*b* branch from each liquid-agent flow path 322*a* and extend in a curved/bent manner therefrom in the upper surface of the slab portion 318.

More specifically, as illustrated in FIG. 15, each liquid-agent flow path 322 includes: one liquid-agent flow path 322*a* extending radially from the central portion of the slab portion 318; and two liquid-agent flow paths 322*b* branching from that liquid-agent flow path 322*a* and extending in a curved/bent manner therefrom. In the present embodiment, the shape of the liquid-agent flow paths 322*b* is not particularly limited, and the liquid-agent flow paths 322*b* may be curved so as to depict an arc from the liquid-agent flow path 322*a*, or may be bent perpendicularly from the liquid-agent flow path 322*a*. Further, the liquid-agent flow paths 322*b* respectively belonging to different liquid-agent flow paths 322 are in communication with one another and thereby constitute an annular flow path 324 extending along the outer circumference of the upper surface of the slab portion 318. The aforementioned foam flow paths 360 provided in the second member 350 are provided at positions opposing the annular flow path 324 in the up-down direction. That is, the foam flow paths 360 are opened toward the annular flow path 324. It is preferable that each foam flow path 360 is provided so as to be opened toward a region where liquid-agent flow paths 322*b* respectively belonging to different liquid-agent flow paths 322 intersect with one another (hereinbelow, this region is referred to as "gas/liquid contact chamber 340").

In the present Description, as illustrated in FIG. 15, a portion of the annular flow path 324 to which the respective foam flow path 360 is opposed and where liquid-agent flow paths 322*b* respectively belonging to different liquid-agent flow paths 322 intersect with one another is referred to as a gas/liquid contact chamber 340. The gas/liquid contact chamber 340 is a region where the liquid agent and the gas contact one another; in the gas/liquid contact chamber 340, the liquid agent and the gas contact one another and are mixed together, and thereby, a foamed liquid agent can be obtained. The liquid agent foamed in the gas/liquid contact chamber 340 will then be emitted from the respective foam flow path 360. Stated differently, by being guided by the liquid-agent flow paths 322, the liquid agent, which has been supplied onto the upper surface of the slab portion 318 through the liquid-agent flow path 320, branches into the liquid-agent flow paths 322*a*, and then further passes through the liquid-agent flow paths 322*b* and flows to a plurality of the gas/liquid contact chambers 340. The liquid agent which has flowed to each gas/liquid contact chamber 340 is then mixed with gas in the gas/liquid contact chamber 340 and made into a foam, and is then emitted from the respective foam flow path 360. Note that, in the present embodiment, at a location where the liquid-agent flow paths 322*b* and the gas/liquid contact chamber 340 intersect with one another, each of the liquid-agent flow paths 322*b* extends on a plane (second plane) 602 (see FIG. 10) intersecting perpendicularly with the up-down direction in which the foam flow path 360 extends—i.e., on the upper surface of the slab portion 318.

In the present embodiment, in a single liquid-agent flow path 322, it is preferable that the two liquid-agent flow paths 322*b* have substantially the same length. Further, between a plurality of liquid-agent flow paths 322, it is preferable that the liquid-agent flow paths 322*a* have substantially the same length, and also the liquid-agent flow paths 322*b* have substantially the same length. Furthermore, between a plurality of liquid-agent flow paths 322, it is preferable that the liquid-agent flow paths 322*a* have substantially the same width, and also the liquid-agent flow paths 322*b* have substantially the same width. Two liquid-agent flow paths 322*b* respectively belonging to different liquid-agent flow paths 322 and configured to supply the liquid agent to one gas/liquid contact chamber 340 are provided opposing one another with the gas/liquid contact chamber 340 located therebetween. At the gas/liquid contact chamber 340, the directions in which the liquid agent flows from the two liquid-agent flow paths 322*b* are opposite from one another. Thus, the liquid agent flowing in from two liquid-agent flow paths 322*b* will collide against each other at the gas/liquid contact chamber 340. Further, in cases where the central portion of the upper surface of the slab portion 318, where the flow direction changes, is considered as the start point, the liquid agent flowing into a single gas/liquid contact chamber 340 from two liquid-agent flow paths 322*b* will have flowed over substantially the same path length, if the length and width between the liquid-agent flow paths 322*a*, as well as between the liquid-agent flow paths 322*b*, are substantially the same, even though the paths up to the gas/liquid contact chamber 340 may be different. As a result, in the present embodiment, the strength of flow (flow velocity; pressure) of the liquid agent flowing in from the two liquid-agent flow paths 322*b* at the gas/liquid contact chamber 340 is substantially equal, and thus, the liquid agent from the two liquid-agent flow paths 322*b* can flow in toward the gas/liquid contact chamber 340 in a balanced manner.

Further, as illustrated in FIG. 15, the entire surface of the gas/liquid contact chamber 340 on the outer circumference side of the slab portion 318 is opened as an opening (first opening) 330*a*, and the opening 330*a* is in communication with one of the plurality of (e.g., eight) gas flow paths 330 provided in the upper surface of the slab portion 318. As described above, the gas flow path 330 is a flow path for supplying gas to the gas/liquid contact chamber 340 in the foamer mechanism 300*b*. Specifically, as illustrated in FIG. 15, the gas flow path 330 extends from the outer circumference toward the respective gas/liquid contact chamber 340 within a plane on the upper surface of the slab portion 318. More specifically, at a location where the gas flow path 330 and the gas/liquid contact chamber 340 intersect with one another, the gas flow path 330 intersects with the gas/liquid contact chamber 340 along a direction different from the direction in which the foam flow path 360 extends. Stated differently, at a location where the gas flow path 330 and the gas/liquid contact chamber 340 intersect with one another, the gas flow path 330 extends on a plane (first plane) 602 (see FIG. 10) that intersects with the up-down direction in which the foam flow path 360 extends. In the present embodiment, at a location where the gas flow path 330 and the gas/liquid contact chamber 340 intersect with one another, the gas flow path 330 extends on a plane 602 intersecting perpendicularly with the up-down direction in which the foam flow path 360 extends—i.e., on the upper surface of the slab portion 318. Further, the plurality of gas flow paths 330 are provided at equiangular intervals along the circumferential direction of the outer circumference of the slab portion 318.

More specifically, in a planar view of the slab portion 318, the direction in which the liquid-agent flow path 322*b* extends at a location where each liquid-agent flow path 322*b* and the gas/liquid contact chamber 340 intersect with one another is perpendicular to the direction in which the gas flow path 330 extends at a location where the gas flow path 330 and the gas/liquid contact chamber 340 intersects with one another. Thus, at the gas/liquid contact chamber 340, the gas flow path 330 can supply gas evenly to both flows of the liquid agent flowing-in toward the foam flow path 360 in a balanced manner from the two directions respectively defined by the liquid-agent flow paths 322*b* provided opposing one another with the gas/liquid contact chamber 340 located therebetween. As a result, in the present embodiment, the liquid agent and the gas can be mixed sufficiently.

Further, in the present embodiment, as illustrated in FIG. 15, the opening 330*a* of the gas flow path 330 is provided opposing a side surface (wall surface) 326*c* of a flow path wall 326*a*, which projects upward from the upper surface of the slab portion 318, with the gas/liquid contact chamber 340 located therebetween. Thus, in the present embodiment, the gas supplied by the gas flow path 330 to the gas/liquid contact chamber 340 will collide against the side surface 326*c* of the flow path wall 326*a*, and will thereby dwell temporarily in the gas/liquid contact chamber 340, and can therefore be mixed sufficiently with the liquid agent in the gas/liquid contact chamber 340.

Note that, as illustrated in the top view of the first member 311, the contours of the liquid-agent flow paths 322*a*, 322*b* and the gas flow paths 330 are defined by: a plurality of (e.g., eight) flow path walls 326*a* that project upward from the upper surface of the slab portion 318 and that have a substantially sector shape (or an isosceles triangular shape with no apex) provided so as to surround the central portion of the upper surface of the slab portion 318; and a plurality of (e.g., eight) flow path walls 326*b* that project upward from the upper surface of the slab portion 318 and that have a substantially sector shape provided so as to surround the plurality of flow path walls 326*a*. Stated differently, the liquid-agent flow paths 322*a*, 322*b* and the gas flow paths 330 are constituted by gaps formed between flow path walls 326 as a result of the flow path walls 326 (more specifically, the flow path walls 326*a*, 326*b*), which project upward from the upper surface of the slab portion 318, coming into contact with the lower surface of the second member 350 (more specifically, the lower surface of a slab portion 352) in a gas-tight (liquid-tight) manner.

More specifically, in the present embodiment, as illustrated in the cross-sectional view of the first member 311 in FIG. 14, it is preferable that an opening (second opening) 322*c* where the liquid-agent flow path 322*b* and the gas/liquid contact chamber 340 come into communication is provided in a manner that the opening center axis of the second opening 322*c* is located closer to the foam flow path 360 than the opening center axis of the opening 330*a* where the gas flow path 330 and the gas/liquid contact chamber 340 come into communication. Stated differently, it is preferable that, in the present embodiment, the gas flow path 330 is provided such that, in the gas/liquid contact chamber 340, the gas is supplied below the liquid agent supplied by the liquid-agent flow paths 322*b*. In this way, the gas supplied by the gas flow path 330 to the gas/liquid contact chamber 340 will rise upward toward the foam flow path 360, and when rising, the gas can be mixed sufficiently with the liquid agent. Further, it is preferable that the opening area of each opening 322*c*, where the liquid-agent flow path 322*b* and the gas/liquid contact chamber 340 come into communication, is smaller than the opening area of the opening 330*a* where the gas flow path 330 and the gas/liquid contact chamber 340 come into communication. In this way, the liquid agent supplied to the gas/liquid contact chamber 541 can be mixed sufficiently with the gas before it is emitted from the foam flow path 360.

As illustrated in the top view of the first member 311 in FIG. 14, a plurality of (e.g., eight) indentations 328 are provided in the outer circumferential portion of the slab portion 318. The indentation 328 constitutes a portion of the aforementioned intake opening 370, and guides the gas supplied from the gas cylinder mechanism 221 to the gas flow path 330. The plurality of indentations 328 are provided at equiangular intervals along the circumferential direction of the outer circumference of the slab portion 318.

As illustrated in the cross-sectional view of the first member 311 in FIG. 14, the small-diameter portion 312, which is located below the large-diameter portion 314, has a circular-cylindrical shape, and the liquid-agent flow path 320 is provided so as to penetrate the central portion thereof in the up-down direction.

As illustrated in the bottom view of the first member 311 in FIG. 14, below the small-diameter portion 312, a plurality of (e.g., four) projections 316 are provided so as to project from the lower end of the small-diameter portion 312. In a planar view of the first member 311 as viewed from below, the projections 316 are each substantially triangular (or substantially sector-shaped), and provided at equiangular intervals along the circumferential direction of the small-diameter portion 312 so as to surround the liquid-agent flow path 320. The lower end of the projections 316 will oppose the aforementioned ball valve 180. Thus, when the ball valve 180 moves upward, the ball valve 180 will contact the lower end of the projections 316, and thereby, the lower end of the projections 316 can restrict further rising of the ball valve 180. Note that, in the present embodiment, the number of projections 316 is not particularly limited, but it is preferable that there are three or more, more preferably four or more, projections.

Figure 16:
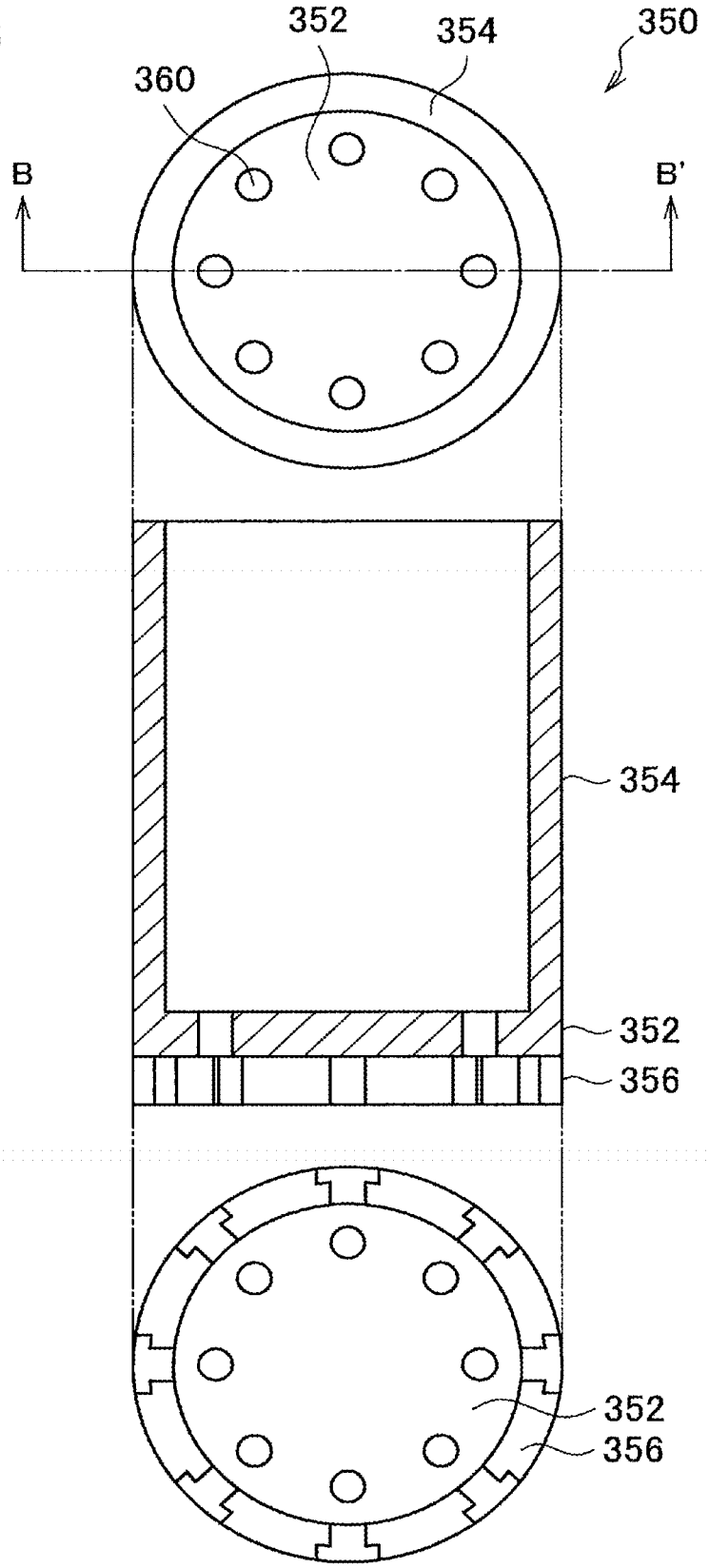
FIG. 16 illustrates explanatory diagrams of a second member 350 according to the third embodiment of the invention.

Second Member 350:

Next, details of the second member 350 will be described with reference to FIG. 16. FIG. 16 illustrates explanatory diagrams of the second member 350 according to the present embodiment, and more specifically, illustrates, from the top side of the figure, a top view of the second member 350, a cross-sectional view of the second member 350 cut along the up-down direction, and a bottom view of the second member 350. More specifically, the cross-sectional view corresponds to a cross section when the second member 350 is cut along line B-B' illustrated in the top view.

As illustrated in FIG. 16, the second member 350 mainly includes: a circular-cylindrical portion 354; and a disk-shaped (circular plate-shaped; dish-shaped) slab portion 352 provided horizontally so as to close the lower side of the cylindrical portion 354; and a plurality of (e.g., eight) outer circumferential walls 356 provided so as to project downward from the outer circumferential portion of the slab portion 352.

More specifically, as illustrated in the top view of the second member 350 in FIG. 16, the cylindrical portion 354 is provided so as to surround the outer circumference of the slab portion 352. Near the outer circumference of the slab portion 352, a plurality of (e.g., eight) circular foam flow paths 360 are provided so as to penetrate the slab portion 352 in the up-down direction. The plurality of foam flow paths 360 are provided at equiangular intervals along the circumferential direction of the outer circumference of the slab portion 352. As described above, each foam flow path 360 is opened to the respective gas/liquid contact chamber 340, and can thus be considered as being provided so as to extend upward from the gas/liquid contact chamber 340. The liquid agent having been foamed by being mixed with the gas in the gas/liquid contact chamber 340 passes through the foam flow path 360 and is then emitted onto the upper surface of the slab portion 352 surrounded by the cylindrical portion 354—i.e., to the upper surface side of the second member 350. Note that, in the present embodiment, the shape of each foam flow path 360 in a planar view of the slab portion 352 is not limited to circular as illustrated in FIG. 16, and may be, for example, elliptic or rectangular.

As illustrated in the bottom view of the second member 350, the plurality of outer circumferential walls 356 are provided projecting downward from the outer circumferential portion of the slab portion 352 so as to surround the center portion of the lower surface of the slab portion 352. A portion (more specifically, the flow path walls 326) projecting from the upper surface of the slab portion 318 of the first member 311 will be inserted into the inner side of the plurality of outer circumferential walls 356. As described above, the central portion of the lower surface of the slab portion 352 (more specifically, the central portion in a planar view of the slab portion 352) will oppose the liquid-agent flow path 320 of the first member 311. Each gap between adjacent outer circumferential walls 356 constitutes a portion of the aforementioned intake opening 370, and thereby, the gas supplied from the gas cylinder mechanism 221 can be guided to the gas flow path 330.

Figure 17:
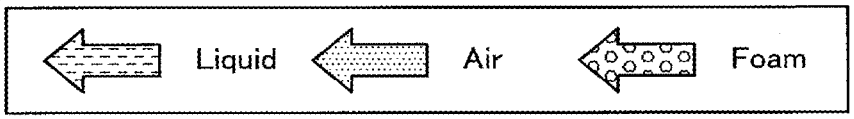
FIG. 17 is a perspective sectional view for illustrating flows of a liquid agent and a gas in the foamer mechanism 300*b* according to the third embodiment of the invention.
Figure 17:
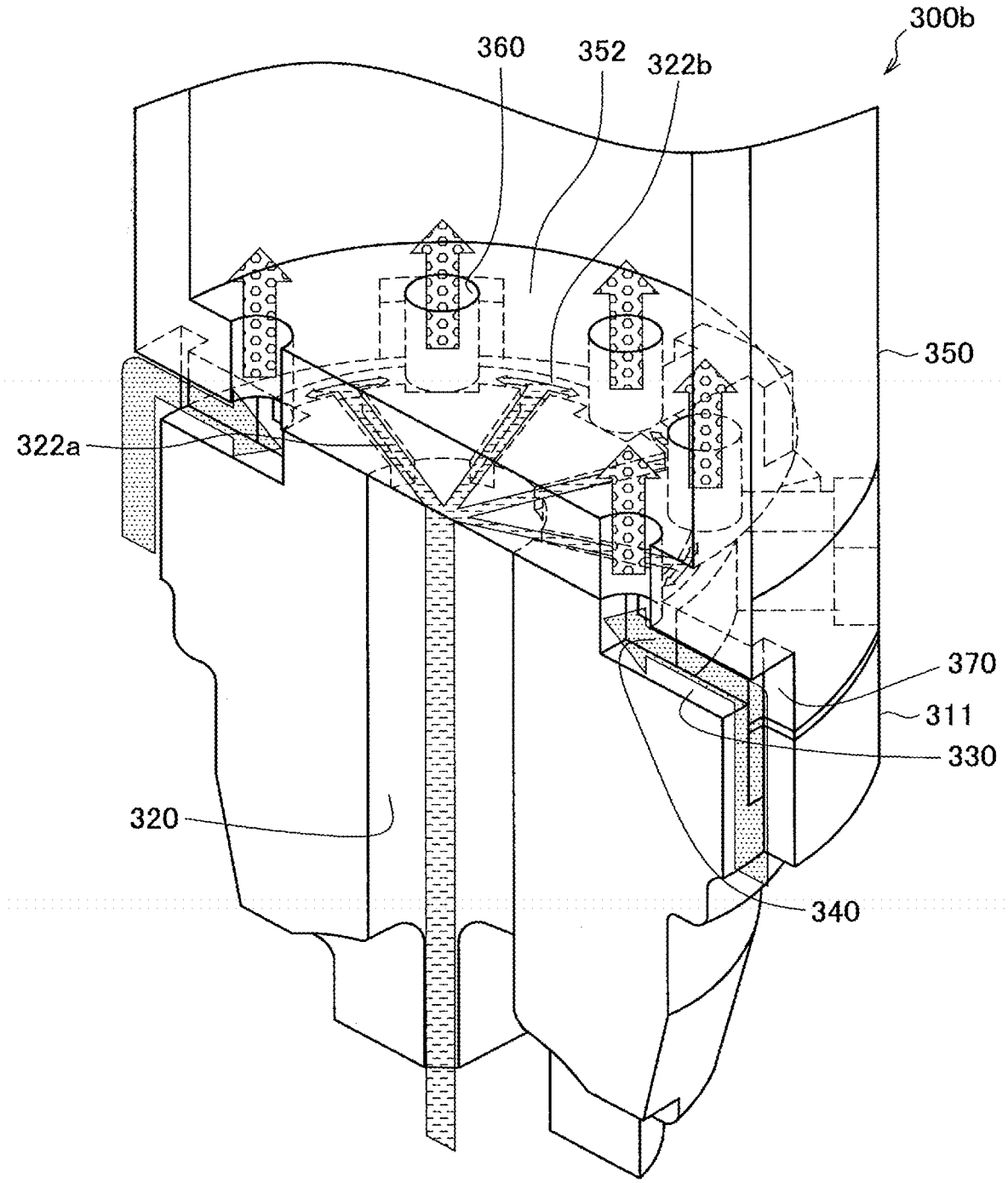
Figure 18:
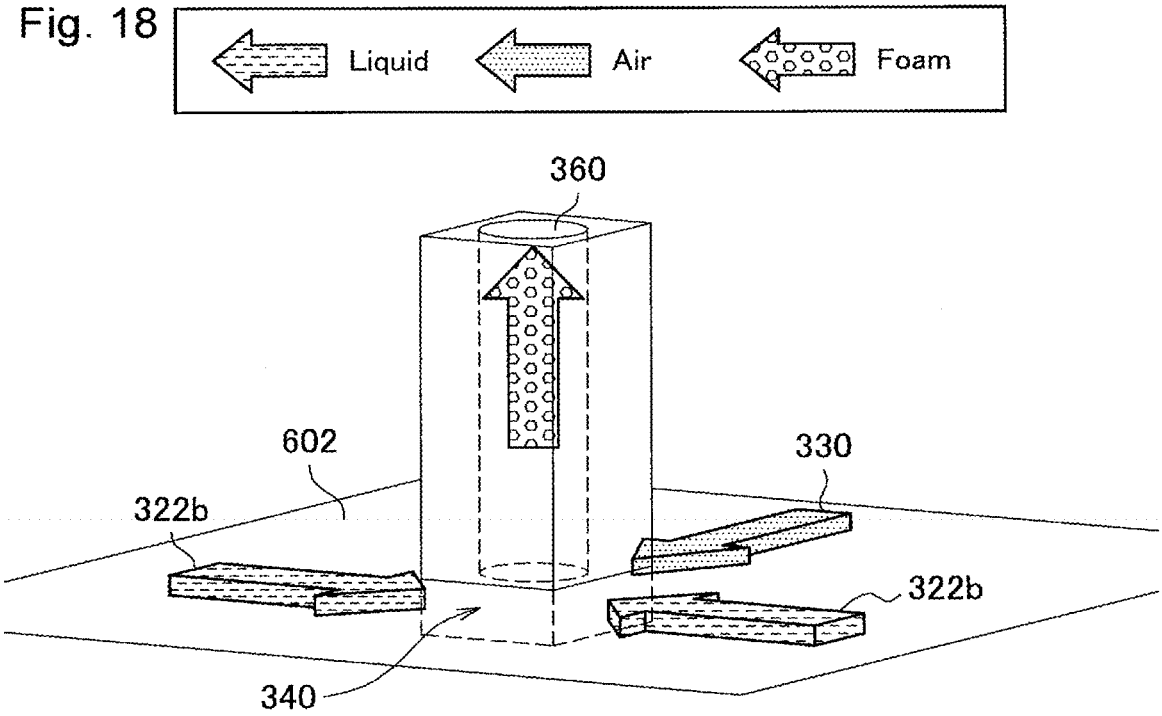
FIG. 18 is a schematic diagram illustrating a gas/liquid contact chamber 340, liquid-agent flow paths 322*b*, a gas flow path 330, and a foam flow path 360 according to the third embodiment of the invention.

Flow of Liquid Agent and Gas in Foamer Mechanism 300*b*:

Next, flows of the liquid agent and the gas in the foamer mechanism 300*b* according to the present embodiment will be described with reference to FIGS. 17, 18, and 19. FIG. 17 is a perspective sectional view for illustrating flows of the liquid agent and the gas in the foamer mechanism 300*b* according to the present embodiment. FIG. 18 is a schematic diagram illustrating the gas/liquid contact chamber 340, the liquid-agent flow paths 322*b*, the gas flow path 330, and the foam flow path 360 according to the present embodiment, and more specifically, schematically illustrates the liquid-agent flow paths 322*b*, the gas flow path 330, and the foam flow path 360 in the periphery of the gas/liquid contact chamber 340. FIG. 20 is a schematic diagram illustrating a gas/liquid contact chamber 541, liquid-agent flow paths 522*b*, a gas flow path 531, and a foam flow path 560 according to a comparative example, and corresponds to FIG. 18. Herein, the comparative example refers to the foam-discharging container disclosed in the aforementioned Patent Literature 3.

First, the flow of the liquid agent in the foamer mechanism 300*b* according to the present embodiment will be described briefly. As illustrated in FIG. 17, the liquid agent supplied by the liquid-agent flow path 320 collides against the central portion of the slab portion 352 of the second member 350, then branches into the liquid-agent flow paths 322*a* in the upper surface of the slab portion 318, and further passes through the liquid-agent flow paths 322*b* to flow into the respective gas/liquid contact chambers 340. Next, the flow of the gas in the foamer mechanism 300*b* according to the present embodiment will be described briefly. As illustrated in FIG. 17, the gas taken in from the intake openings 370 passes through the respective gas flow paths 330 extending on the upper surface of the slab portion 318, and flows into the respective gas/liquid contact chambers 340. Further, in the foamer mechanism 300*b* according to the present embodiment, the liquid agent and the gas contact one another and are mixed together in each of the gas/liquid contact chambers 340, and the foamed liquid agent obtained thereby is emitted upward from the respective foam flow paths 360 extending along the up-down direction.

The gas/liquid contact chamber 340 according to the present embodiment will be described in further detail. As illustrated in FIG. 18, in the present embodiment, at a location where the liquid-agent flow paths 322*b* and the gas/liquid contact chamber 340 intersect with one another, each of the liquid-agent flow paths 322*b* extends on a plane (second plane) 602 intersecting perpendicularly with the up-down direction in which the foam flow path 360 extends—i.e., on the upper surface of the slab portion 318. In addition, in the present embodiment, at a location where the gas flow path 330 and the gas/liquid contact chamber 340 intersect with one another, the gas flow path 330 extends on a plane (first plane) 602 intersecting perpendicularly with the up-down direction in which the foam flow path 360 extends i.e., on the upper surface of the slab portion 318.

On the other hand, in the comparative example, as illustrated in FIG. 20, at a location where the liquid-agent flow paths 522*b* and the gas/liquid contact chamber 541 intersect with one another, each of the liquid-agent flow paths 522*b* extends on a plane 702 intersecting perpendicularly with the up-down direction in which the foam flow path 560 extends, as in the present embodiment. However, in the comparative example, different from the present embodiment, at a location where the gas flow path 531 and the gas/liquid contact chamber 541 intersect with one another, the gas flow path 531 extends along the up-down direction in which the foam flow path 560 extends.

In the comparative example, the gas flow path 531 extends along the same direction as the direction in which the foam flow path 560 extends. Thus, the gas and the foamed liquid agent both flow in line with one another from below toward above (which creates laminar flow). Thus, in the comparative example, the gas supplied to the gas/liquid contact chamber 541 by the gas flow path 531 is immediately emitted to above the gas/liquid contact chamber 541 by action of the laminar flow, thus making it difficult to mix the gas sufficiently with the liquid agent.

In contrast, in the present embodiment, the gas flow path 330 does not extend along the same direction as the direction in which the foam flow path 360 extends. More specifically, the gas flow path extends in a direction perpendicular to the direction in which the foam flow path 360 extends. Thus, the gas and the foamed liquid agent do not flow in line with one another from below toward above, and therefore, creation of laminar flow can be suppressed. Thus, in the present embodiment, the gas supplied to the gas/liquid contact chamber 340 by the gas flow path 330 can be suppressed from being immediately emitted to above the gas/liquid contact chamber 340 by action of laminar flow. Therefore, the gas can be mixed sufficiently with the liquid agent.

Further, in the present embodiment, the gas flow path 330 is provided opposing the side surface (wall surface) 326*c* of the flow path wall 326*a* with the gas/liquid contact chamber 340 located therebetween. Thus, in the present embodiment, the gas supplied to the gas/liquid contact chamber 340 by the gas flow path 330 will collide against the side surface 326*c* of the flow path wall 326*a*, and will thereby dwell temporarily in the gas/liquid contact chamber 340. Therefore, the gas can be mixed sufficiently with the liquid agent in the gas/liquid contact chamber 340.

As described above, according to the present embodiment, the content of gas in the foamed liquid agent can be further increased. More specifically, depending on the use etc. of the liquid agent, there are cases where a large content of gas (high air ratio) in the foamed liquid agent is preferred; the present embodiment can obtain suitable foam because it is possible to further increase the content of the gas in the foamed liquid agent. Particularly, in the comparative example, in cases where the depression speed of the head portion 230*b*'s operation portion 232 by a user is fast, the flow velocity of gas supplied to the foamer mechanism 300*b* also becomes fast; thus, the gas is emitted promptly to above the gas/liquid contact chamber 541, thereby rendering the comparative example incapable of sufficiently mixing the gas with the liquid agent. In contrast, according to the present embodiment, the gas can be mixed sufficiently with the liquid agent, even when the pressing speed is fast. Further, the comparative example may be incapable of sufficiently mixing the gas and the liquid agent not only in cases where the depression speed is fast but also depending on the composition of the liquid agent. In contrast, the present embodiment can mix the gas and the liquid agent sufficiently, even when the composition of the liquid agent is changed.

MODIFIED EXAMPLE

In the foregoing third embodiment of the invention, the gas flow path 330 is configured so as not to extend along the same direction as the direction in which the foam flow path 360 extends—i.e., so as to extend perpendicularly to the direction in which the foam flow path 360 extends to thereby suppress creation of laminar flow and enable sufficient mixing of the gas and the liquid agent. In the present embodiment, however, the direction in which the gas flow path 330 extends is not limited to a direction perpendicular to the direction in which the foam flow path 360 extends. A modified example of the present embodiment—which is an example wherein a gas flow path 330*b* extends in a direction oblique to the same direction as the direction in which the foam flow path 360 extends—will be described with reference to FIG. 19. FIG. 19 is a schematic diagram illustrating a gas/liquid contact chamber 340, liquid-agent flow paths 322*b*, a gas flow path 330*b*, and a foam flow path 360 according to a modified example of the present embodiment.

Figure 19:
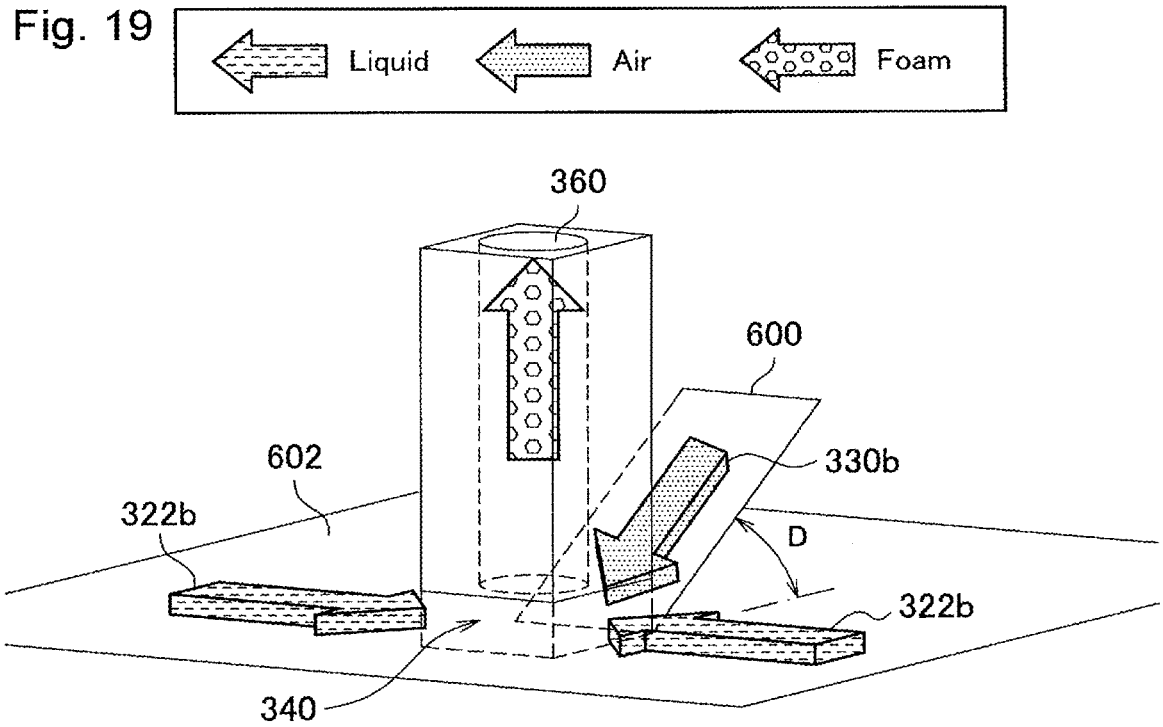
FIG. 19 is a schematic diagram illustrating a gas/liquid contact chamber 340, liquid-agent flow paths 322*b*, a gas flow path 330*b*, and a foam flow path 360 according to a modified example of the third embodiment of the invention.
Figure 20:
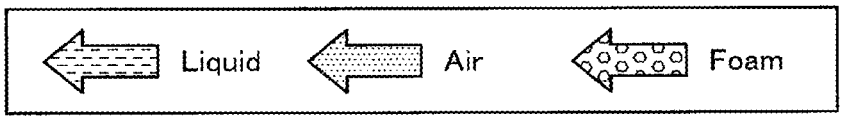
FIG. 20 is a schematic diagram illustrating a gas/liquid contact chamber 541, liquid-agent flow paths 522*b*, a gas flow path 531, and a foam flow path 560 according to a comparative example.
Figure 20:
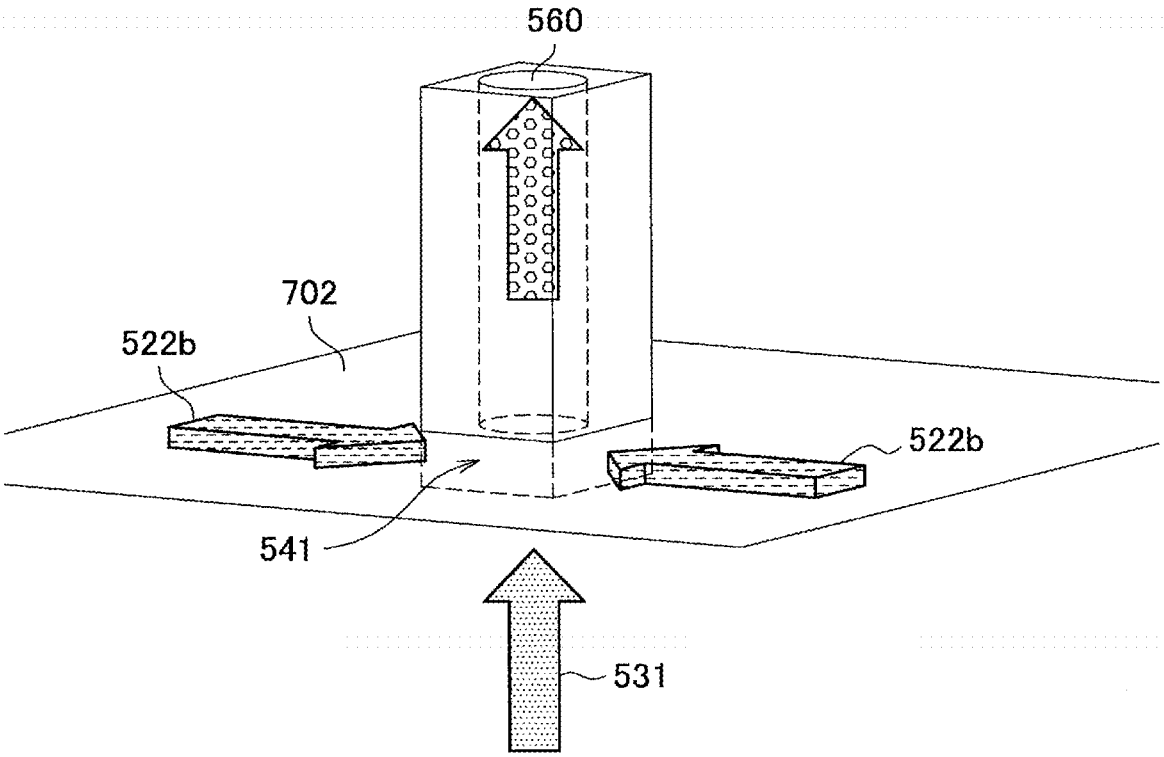

As in the present embodiment described above, also in the modified example, at a location where the liquid-agent flow paths 322*b* and the gas/liquid contact chamber 340 intersect with one another, each of the liquid-agent flow paths 322*b* extends on a plane (second plane) 602 intersecting perpendicularly with the up-down direction in which the foam flow path 360 extends—i.e., on the upper surface of the slab portion 318—as illustrated in FIG. 19. On the other hand, different from the present embodiment described above, in the modified example, at a location where the gas flow path 330*b* and the gas/liquid contact chamber 340 intersect with one another, the gas flow path 330*b* extends on a plane (first plane) 600 intersecting obliquely with the up-down direction in which the foam flow path 360 extends. Further, in the modified example, the angle D formed between the plane 600 and the plane 602 is preferably from −45° to 60° (the foregoing embodiment of the invention corresponds to a configuration where the angle D is 0°). Note that, in the modified example, as regards the angle D, an angle formed between the plane 602 and a plane 600 located above the plane 602 has a positive value as illustrated in FIG. 19, whereas an angle formed between the plane 602 and a plane 600 located below the plane 602 has a negative value. Further, in the modified example, the angle D is more preferably −30° or greater, even more preferably −15° or greater, and more preferably 50° or less, even more preferably 45° or less.

In the modified example, the gas flow path 330*b* does not extend along the same direction as the direction in which the foam flow path 360 extends. More specifically, the gas flow path extends in a direction oblique to the direction in which the foam flow path 360 extends. Thus, as in the foregoing embodiment of the invention, also in the modified example, the gas and the foamed liquid agent do not flow in the same direction, and therefore, creation of laminar flow can be suppressed. Thus, also in the modified example, the gas supplied to the gas/liquid contact chamber 340 by the gas flow path 330*b* can be suppressed from being immediately emitted to above the gas/liquid contact chamber 340 by action of laminar flow. Therefore, the gas can be mixed sufficiently with the liquid agent.

Further, also in the modified example, it is preferable that the gas flow path 330*b* is provided opposing the side surface (wall surface) 326*c* of the flow path wall 326*a* with the gas/liquid contact chamber 340 located therebetween. Thus, also in the modified example, the gas supplied to the gas/liquid contact chamber 340 by the gas flow path 330*b* will collide against the side surface 326*c* of the flow path wall 326*a*, and will thereby dwell temporarily in the gas/liquid contact chamber 340. Therefore, the gas can be mixed sufficiently with the liquid agent in the gas/liquid contact chamber 340.

Conclusion:

As described above, with the foam-discharging containers 10 of the first and second embodiments of the invention, it is possible to provide a foam-discharging container 10 capable of discharging a foamed liquid agent with further improved fineness and uniformity.

With the third embodiment of the invention and modified example thereof, it is possible to provide a foam-discharging container 10*b* capable of further increasing the content of gas in a foamed liquid agent.

The structures and movements of the foam-discharging containers 10, 10*b* described above are strictly examples, and known structures may be applied to the foregoing embodiments within a scope that does not depart from the gist of the invention.

The components constituting the foam-discharging containers 10, 10*b* according to the foregoing embodiments of the invention can be, for example, made from any of various resin materials, although not particularly limited thereto. The foam-discharging containers 10, 10*b* can be manufactured by any of various known molding processes.

The foam-discharging containers 10 of the first and second embodiments of the invention are not limited to pump foamer-type containers, and may be, for example, so-called squeeze foamer-type containers, wherein a user squeezes the container body 100 to thereby transform a liquid agent into a foam and discharge the foam. In this case, the container body 100 is compressed by the user and the volume of the interior space is thus reduced, and thereby, the liquid agent and the gas inside the container body 100 are pressurized and thus supplied to the foamer mechanism 300. The foamer mechanism 300, to which the liquid agent and the gas have been supplied, mixes the liquid agent and the gas together to produce a foamed liquid agent, as in the foregoing first and second embodiments. Therefore, in cases where the foam-discharging container 10 is a squeeze foamer-type container, a side surface portion of the container body 100 can be considered as having the same function as the operation portion 232 in the foregoing first and second embodiments.

In the third embodiment, the shape/configuration of the head portion 230*b* and the nozzle portion 240*b* is not limited to the shape/configuration described above, and may have the same shape/configuration as the head portion 230 and the nozzle portion 240 of the first embodiment, or may have the same shape/configuration as the head portion 230*a* and the nozzle portion 240*a* of the second embodiment.

Preferred embodiments of the invention have been described in detail above with reference to the accompanying drawings, but the technical scope of the invention is not limited to the foregoing examples. It is apparent that a person having ordinary skill in the art pertaining to the invention can arrive at various alterations and modifications within the scope of the technical concept described in the claims, and it should be understood that such alterations/modifications are also within the technical scope of the invention.

In relation to the foregoing embodiments, the invention further discloses the following foam dischargers and foam-discharging containers.

{1}

A foam discharger comprising:

a mixing portion configured to mix a liquid agent and a gas to foam the liquid agent into a foamed liquid agent;

a discharge opening configured to discharge the foamed liquid agent; and a flow path in communication with the discharge opening, and configured to supply the foamed liquid agent from the mixing portion to the discharge opening, wherein:

the discharge opening is provided with a first porous member;

on an upstream side of the first porous member, a cross-sectional area of the flow path on a cross section orthogonal to a supply direction in which the foamed liquid agent is to be supplied increases along the supply direction; and the cross-sectional area of the flow path at the discharge opening is at least 1.2 times a minimum cross-sectional area of the flow path.

{2}

The foam discharger as set forth in clause {1}, wherein a cross-sectional area of the first porous member on a cross section orthogonal to the supply direction is at least 1.2 times the minimum cross-sectional area.

{3}

The foam discharger as set forth in clause {1} or {2}, wherein, on the upstream side of the first porous member, the cross-sectional area of the flow path on the cross section orthogonal to the supply direction, in which the foamed liquid agent is to be supplied, gradually increases along the supply direction toward the discharge opening.

{4}

The foam discharger as set forth in any one of clauses {1} to {3}, wherein a length of the flow path from the first porous member to an opening end of the discharge opening is 10 mm or less.

{5}

The foam discharger as set forth in any one of clauses {1} to {4}, wherein a length of the flow path from the first porous member to a position of the minimum cross-sectional area where the cross-sectional area of the flow path becomes smallest is 3 mm or greater.

{6}

The foam discharger as set forth in any one of clauses {1} to {4}, wherein: the flow path includes a foam flow path that extends along a horizontal direction or extends in a manner sloping downward toward the discharge opening, and a communication flow path that is in communication with an upstream side of the foam flow path, and that extends in an up-down direction from an upper end of the mixing portion toward the foam flow path; and the flow path has the minimum cross-sectional area at a connecting portion between the foam flow path and the communication flow path.

{7}

The foam discharger as set forth in clause {6}, wherein:

the mixing portion includes a mixing chamber in which the liquid agent and the gas having been supplied are mixed together; and a length of the flow path from the first porous member to the mixing chamber is 15 mm or greater.

{8}

The foam discharger as set forth in any one of clauses {1} to {4}, wherein the mixing portion includes one or a plurality of second porous members.

{9}

The foam discharger as set forth in clause {8}, wherein:

the flow path is in communication with the second porous member located on a downstream side among the second porous members; and a length of the flow path from the second porous member located on the upstream side to the first porous member is 10 mm or greater.

{10}

The foam discharger as set forth in any one of clauses {1} to {9}, wherein:

the mixing portion includes gas/liquid contact chambers, each configured to make the liquid agent and the gas contact one another, a plurality of liquid-agent flow paths configured to supply the liquid agent respectively to the gas/liquid contact chambers, gas flow paths, each configured to supply the gas respectively to the gas/liquid contact chambers, and foam flow paths, each configured to supply the foamed liquid agent respectively from the gas/liquid contact chambers toward the discharge opening; and at a location where the gas flow path and the gas/liquid contact chamber intersect with one another, the gas flow path extends on a first plane that intersects with a direction in which the foam flow path extends.

{11}

A foam discharger comprising:

a mixing portion configured to mix a liquid agent and a gas to foam the liquid agent into a foamed liquid agent; and a discharge opening configured to discharge the foamed liquid agent, wherein:

the mixing portion includes gas/liquid contact chambers, each configured to make the liquid agent and the gas contact one another, a plurality of liquid-agent flow paths configured to supply the liquid agent respectively to the gas/liquid contact chambers, gas flow paths, each configured to supply the gas respectively to the gas/liquid contact chambers, and foam flow paths, each configured to supply the foamed liquid agent respectively from the gas/liquid contact chambers toward the discharge opening; and at a location where the gas flow path and the gas/liquid contact chamber intersect with one another, the gas flow path extends on a first plane that intersects with a direction in which the foam flow path extends.

{12}

The foam discharger as set forth in clause {10} or {11}, wherein an angle formed between the first plane and a second plane intersecting perpendicularly with the direction in which the foam flow path extends is from −45° to 60°.

{13}

The foam discharger as set forth in clause {12}, wherein the angle is preferably −30° or greater, more preferably −15° or greater, and preferably 50° or less, more preferably 45° or less.

{14}

The foam discharger as set forth in any one of clauses {10} to {13}, wherein, at a location where the liquid-agent flow paths and the gas/liquid contact chamber intersect with one another, the liquid-agent flow paths extend on the second plane.

{15}

The foam discharger as set forth in any one of clauses {10} to {14}, wherein, at the location where the gas flow path and the gas/liquid contact chamber intersect with one another, the gas flow path extends on the first plane intersecting perpendicularly with the direction in which the foam flow path extends.

{16}

The foam discharger as set forth in any one of clauses {10} to {15}, wherein:

the mixing portion includes two said liquid-agent flow paths configured to supply the liquid agent per one said gas/liquid contact chamber; and the liquid-agent flow paths are provided opposing one another with the gas/liquid contact chamber located therebetween.

{17}

The foam discharger as set forth in any one of clauses {10} to {16}, wherein a first opening where the gas flow path and the gas/liquid contact chamber come into communication is provided opposing a wall surface with the gas/liquid contact chamber located therebetween.

{18}

The foam discharger as set forth in clause {17}, wherein a second opening where the liquid-agent flow path and the gas/liquid contact chamber come into communication is provided in a manner that an opening center axis of the second opening is located closer to the foam flow path than an opening center axis of the first opening.

{19}

The foam discharger as set forth in clause {18}, wherein the opening area of each second opening is smaller than the opening area of the first opening.

{20}

The foam discharger as set forth in any one of clauses {10} to {19}, wherein the foam flow path is provided extending upward from the gas/liquid contact chamber along an up-down direction of the foam discharger.

{21}

The foam discharger as set forth in clause {20}, wherein, in a planar view in which the gas/liquid contact chamber is viewed from above, a direction in which the gas flow path extends at the location where the gas flow path and the gas/liquid contact chamber intersect with one another intersects perpendicularly with a direction in which each of the liquid-agent flow paths extends at the location where the liquid-agent flow paths and the gas/liquid contact chamber intersect with one another.

{22}

The foam discharger as set forth in clause {20} or {21}, wherein the mixing portion includes, in combination, a first member and a second member in order from the lower side of the foam discharger.

{23}

The foam discharger as set forth in clause {22}, wherein, in a planar view in which the foam discharger is viewed from above, a center axis penetrating the center of the first member and a center axis penetrating the center of the second member 350 are coaxial.

{24}

The foam discharger as set forth in clause {22} or {23}, wherein:

the liquid-agent flow path is provided so as to penetrate a central portion of the first member along the up-down direction;

an upper surface of the first member is provided with a plurality of first liquid-agent small flow paths extending radially from the liquid-agent flow path, and two second liquid-agent small flow paths branching from each of the first liquid-agent small flow paths and extending in a curved/bent manner therefrom; and each second liquid-agent small flow path is in communication with the gas/liquid contact chamber through the respective second opening.

{25}

The foam discharger as set forth in any one of clauses {22} to {24}, wherein a plurality of intake openings, each configured to take in the gas into the mixing portion, are provided in the outer circumference of the mixing portion.

{26}

The foam discharger as set forth in clause {25}, wherein the gas flow paths are provided on the upper surface of the first member so as to be in communication with the respective intake openings.

{27}

The foam discharger as set forth in any one of clauses {22} to {26}, wherein the foam flow path is provided so as to penetrate the second member along the up-down direction.

{28}

A foam-discharging container comprising: the foam discharger as set forth in any one of clauses {10} to {27}; and a container body configured to be filled with the liquid agent.

{29}

A foam-discharging container comprising:

a container body configured to be filled with a liquid agent;

the foam discharger as set forth in any one of clauses {1} to {26}, the foam discharger being configured to be attached to a neck portion of the container body; and an operation portion configured to receive pressing operation by a user, and the foamed liquid agent being discharged by pressing of the operation portion.

{30}

The foam-discharging container as set forth in clause {29}, further comprising:

a cap member configured to be attached to the neck portion; and a head portion supported by the cap member, wherein:

the head portion is provided with the discharge opening and the operation portion; and by pressing of the operation portion by the user, the head portion is pressed down and the foamed liquid agent is discharged.

EXAMPLES

Figure 21:
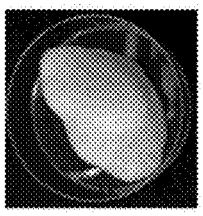
FIG. 21 illustrates images (photographs) of liquid agent foams discharged onto a sample container respectively from foam-discharging containers according to Examples 1 to 5 of the first embodiment of the invention and Comparative Examples 1 and 2.
Figure 21:
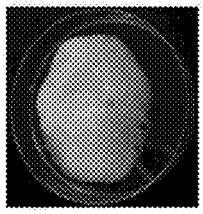
Figure 21:
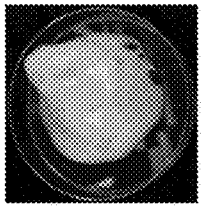
Figure 21:
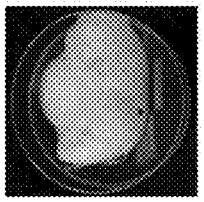
Figure 21:
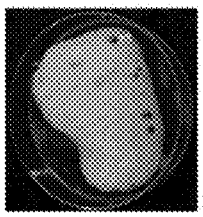
Figure 21:
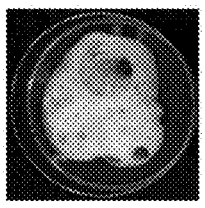
Figure 21:
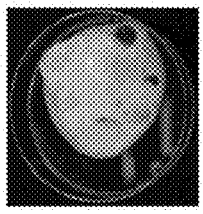

The following describes, with reference to FIG. 21, examples of foamed liquid agents (foams) obtained by using a foam-discharging container 10 having a head portion according to the foregoing first or second embodiment of the invention. FIG. 21 shows photographed images of foamed liquid agents (foams) discharged onto a sample container respectively from foam-discharging containers according to present working examples and comparative examples.

Figure 22:
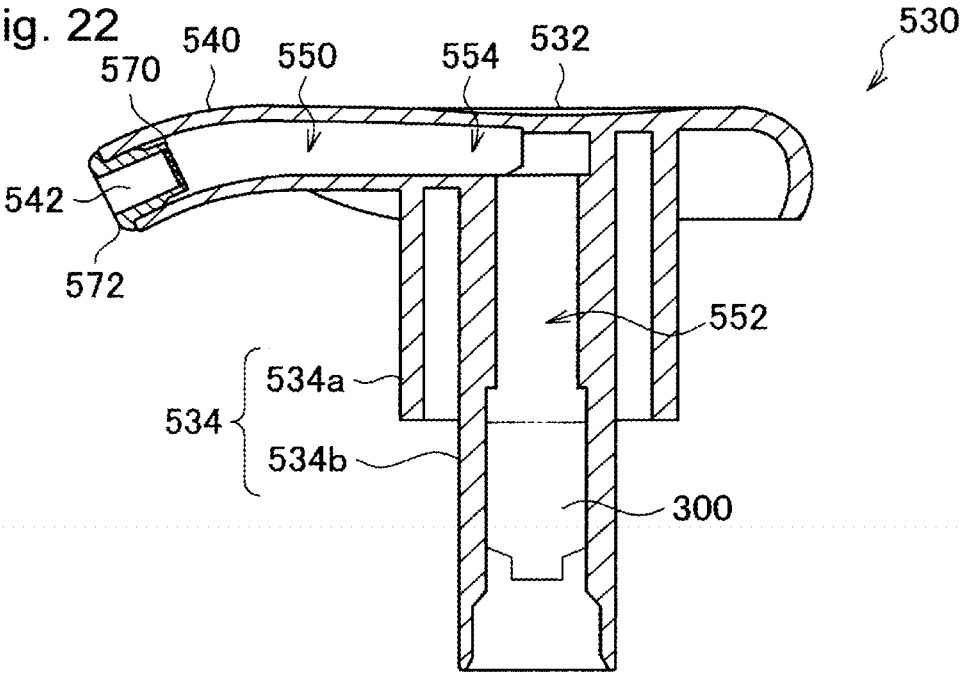
FIG. 22 is an explanatory diagram illustrating a sectional side view of a head portion 530 according to a comparative example.
Figure 23:
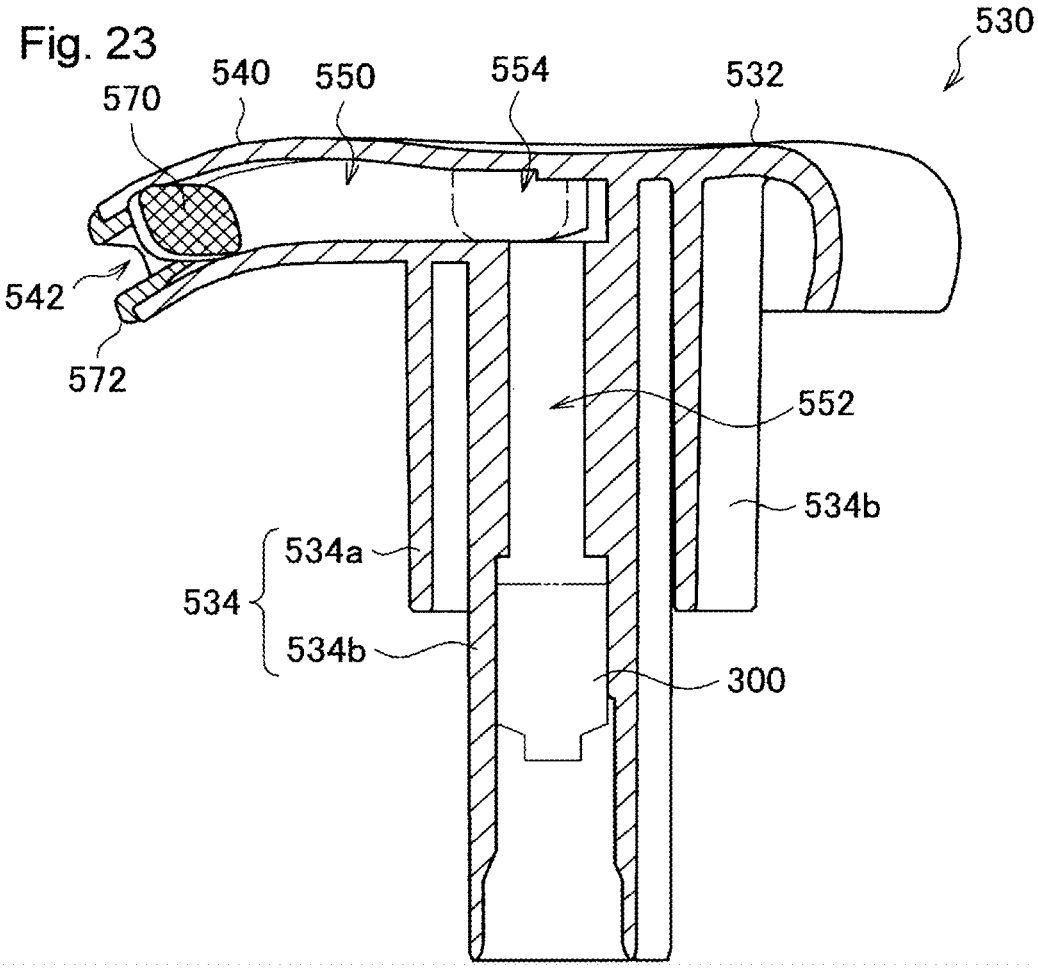
FIG. 23 is a perspective view of the side section illustrated in FIG. 22.

Herein, the comparative examples employ a foam-discharging container having a head portion 530 as illustrated in FIGS. 22 and 23. FIG. 22 is an explanatory diagram illustrating a sectional side view of a head portion 530 according to the comparative example, and more specifically, illustrates a side section of the head portion 530 cut along the center axis of the foam-discharging container. FIG. 23 is a perspective view of the side section illustrated in FIG. 22, and more specifically, is a diagram of the side section of the head portion 530 illustrated in FIG. 22, rotated about the center axis. FIG. 23 illustrates a porous element 570 in a non-cut state.

As illustrated in FIG. 22, the head portion 530 according to the comparative example mainly includes a nozzle portion 540 having a discharge opening 542, an operation portion 532, and a cylindrical portion 534, as in the first or second embodiment of the invention. The cylindrical portion 534 includes an outer cylindrical portion 534*a* and an inner cylindrical portion 534*b*. Further, as illustrated in FIG. 22, a foamer mechanism 300 similar to the foregoing embodiments is provided to the lower side of the inner cylindrical portion 534*b*. A communication flow path 552 that is in communication with an upper end portion of the foamer mechanism 300 and that extends in the up-down direction is provided in the upper section of the inner cylindrical portion 534*b*.

Further, a foam flow path 550, through which a liquid agent foamed by the foamer mechanism 300 passes, is provided inside the nozzle portion 540 according to the comparative example. Note, however, that the foam flow path 550 is different from that of the first or second embodiment in that the inner diameter thereof does not increase toward the discharge opening 242, but rather, the inner diameter is substantially the same from a connecting portion 554, where the foam flow path is connected to the communication flow path 552, to the discharge opening 542. As illustrated in FIG. 22, in the comparative example, a porous fitting member 572 having a porous element 570 is provided to the tip end of the nozzle portion 540, as in the foregoing first embodiment. In the comparative example, as illustrated in FIG. 23, the cross-sectional area of the porous element 570 (more specifically, the cross-sectional area on a cross section orthogonal to the supply direction) is smaller than the cross-sectional area (minimum cross-sectional area) of the foam flow path 550 at the connecting portion 554.

Next, examples of foamed liquid agents obtained by using the foam-discharging container 10 having the head portion 230, 230*a* according to the first or second embodiment of the invention (Examples 1 to 5) and the foam-discharging container having the head portion 530 according to the aforementioned comparative example (Comparative Examples 1 and 2), are described with reference to FIG. 21. In the following description, the cross-sectional area of the porous element 270 of the head portion 230 according to Example 1 was 3.0 times (in terms of cross-sectional area ratio) with respect to the cross-sectional area of the foam flow path 250 at the connecting portion 254 (i.e., the minimum cross-sectional area). The cross-sectional area of the porous element 270 of the head portion 230 according to Example 2 was 1.2 times the cross-sectional area of the foam flow path 250 at the connecting portion 254 (i.e., the minimum cross-sectional area). The cross-sectional area of the porous element 270 according to Example 3 was 1.9 times the minimum cross-sectional area. The cross-sectional area of the porous element 270 according to Example 4 was 2.6 times the minimum cross-sectional area. The cross-sectional area of the porous element 270 according to Example 5 was 1.2 times the minimum cross-sectional area. In Example 1, the length L of the foam flow path 250, along the supply direction of the foamed liquid agent, from the porous element 270 to the connecting portion 254 where the cross-sectional area became the smallest was 25.6 mm. In Examples 2 to 4, the length L was 5 mm. In Example 5, the length L was 3 mm. The cross-sectional area of the porous element 570 of the head portion 530 according to Comparative Example 1 was 0.5 times the cross-sectional area of the foam flow path 550 at the connecting portion 554 (i.e., the minimum cross-sectional area). The cross-sectional area of the porous element 570 of the head portion 530 according to Comparative Example 2 was 0.8 times the cross-sectional area of the foam flow path 550 at the connecting portion 554 (i.e., the minimum cross-sectional area). In Comparative Examples 1 and 2, the length L of the foam flow path 550, along the supply direction of the foamed liquid agent, from the porous element 570 to the connecting portion 554 where the cross-sectional area became the smallest was 5 mm.

FIG. 21 illustrates photographed images of foamed liquid agents discharged onto a sample container respectively from the respective foam-discharging containers according to Examples 1 to 5 and Comparative Examples 1 and 2, and more specifically, illustrates photographed images of foamed liquid agents discharged when the depression speed of the operation portion 232 was kept constant. In Examples 1 to 5 and Comparative Examples 1 and 2, the faster the depression speed of the operation portion 232 by the pressing operation, the faster the flow velocity of the foamed liquid agent supplied from the foamer mechanism 300.

FIG. 21 shows that the foam-discharging container according to Comparative Examples 1 and 2 discharged non-uniform liquid agent foams containing large bubbles ("crab bubbles"). More specifically, in Comparative Examples 1 and 2, the porous element 570 did not exert a fining effect, and the foam appearance and foam quality deteriorated significantly. In contrast, the foam-discharging containers 10 according to Examples 1 to 5 discharged fine liquid agent foams with further improved uniformity. Particularly, the foam-discharging containers 10 according to Examples 1 to 5 discharged fine liquid agent foams with further improved uniformity, even when the depression speed of the operation portion 232 was fast. It should be noted that, in Comparative Examples 1 and 2, there were cases where the foam appearance and foam quality deteriorated significantly, not only in cases where the depression speed was fast, but also depending on the composition of the liquid agent. In contrast, in Examples 1 to 5, fine liquid agent foams with further improved uniformity were discharged, even when the composition of the liquid agent was changed.

The deterioration in foam quality in the comparative examples may be attributable to the fast flow velocity of the foamed liquid agent when it passes through the porous element 570. In Examples 1 to 5, on the other hand, the cross-sectional area of the foam flow path 250, 250*a* gradually increases toward the discharge opening 242; this reduces the flow velocity of the foamed liquid agent when it passes through the porous element 270. As a result, in Examples 1 to 5, it is assumed that: by reducing the flow velocity of the foamed liquid agent, it is possible to uniformize the liquid agent passing through the foam flow path 250, 250*a* by the action of laminar flow generated therein; and further, by causing the uniformized liquid agent to pass through the porous element 270, 270*a* at low speed, it is possible to obtain a finer foam with further improved uniformity. Further, the photographed images of the foamed liquid agents corresponding to Examples 2 to 4 and Comparative Examples 1 and 2—which all had the same length L but had porous elements 270 with different cross-sectional areas show that fine foams with further improved uniformity were obtained in cases where the cross-sectional area of the porous element 270 was further increased compared to the foam flow path 250's cross-sectional area at the connecting portion 254 (i.e., minimum cross-sectional area). Furthermore, the photographed images of the foamed liquid agents corresponding to Examples 2 and 5—which both had porous elements 270 with the same cross-sectional area but had different lengths L—show that, by further increasing the foam flow path 550's length L from the porous element 570 to the connecting portion 554, where the cross-sectional area becomes the smallest, along the supply direction of the foamed liquid agent, it is possible to make the foamed liquid agent finer, and also further improve the uniformity of the foamed liquid agent.

The above results show that, according to the first or second embodiment, it is possible to discharge fine liquid agent foams with improved uniformity.

INDUSTRIAL APPLICABILITY

As described above, the foam discharger according to the invention is capable of discharging a fine liquid agent foam with improved uniformity. Also, as described above, the foam discharger according to the invention is capable of further increasing the content of gas in a foamed liquid agent.

The invention claimed is:

1. A foam discharger comprising:

a mixing portion configured to mix a liquid agent and a gas to foam the liquid agent into a foamed liquid agent;

a discharge opening configured to discharge the foamed liquid agent; and a flow path in communication with the discharge opening, and configured to supply the foamed liquid agent from the mixing portion to the discharge opening, wherein:

the discharge opening is provided with a first porous member;

on an upstream side of the first porous member, a cross-sectional area of the flow path on a cross section orthogonal to a supply direction in which the foamed liquid agent is to be supplied increases along the supply direction;

the cross-sectional area of the flow path at the discharge opening is at least 1.2 times a minimum cross-sectional area of the flow path;

the mixing portion includes gas/liquid contact chambers, each configured to make the liquid agent and the gas contact one another, a liquid-agent flow path configured to supply the liquid agent to the gas/liquid contact chambers, a gas flow path configured to supply the gas to the gas/liquid contact chambers, and foam flow paths, each configured to supply the foamed liquid agent respectively from the gas/liquid contact chambers toward the discharge opening; and at a location where the gas flow path and one of the gas/liquid contact chambers intersect with one another, the gas flow path extends on a first plane that intersects with a direction in which one of the foam flow paths extends.

2. The foam discharger according to claim 1, wherein a cross-sectional area of the first porous member on a cross section orthogonal to the supply direction is at least 1.2 times the minimum cross-sectional area.

3. The foam discharger according to claim 1, wherein, on the upstream side of the first porous member, the cross-sectional area of the flow path on the cross section orthogonal to the supply direction, in which the foamed liquid agent is to be supplied, gradually increases along the supply direction toward the discharge opening.

4. The foam discharger according to claim 1, wherein a length of the flow path from the first porous member to an opening end of the discharge opening is 10 mm or less.

5. The foam discharger according to claim 1, wherein a length of the flow path from the first porous member to a position of the minimum cross-sectional area where the cross-sectional area of the flow path becomes smallest is 3 mm or greater.

6. The foam discharger according to claim 1, wherein:

the flow path includes an upper foam flow path that extends along a horizontal direction or extends in a manner sloping downward toward the discharge opening, and a communication flow path that is in communication with an upstream side of the upper foam flow path, and that extends in an up-down direction from an upper end of the mixing portion toward the upper foam flow path; and the flow path has the minimum cross-sectional area at a connecting portion between the upper foam flow path and the communication flow path.

7. The foam discharger according to claim 6, wherein:
the mixing portion includes a mixing chamber in which the liquid agent and the gas having been supplied are mixed together; and
a length of the flow path from the first porous member to the mixing chamber is 15 mm or greater.

8. The foam discharger according to claim 1, wherein the mixing portion includes one or a plurality of second porous members.

9. The foam discharger according to claim 8, wherein:
the flow path is in communication with a second porous member located on a downstream side among the one or the plurality of second porous members; and
a length of the flow path from a second porous member located on the upstream side among the one or the plurality of second porous members to the first porous member is 10 mm or greater.

10. The foam discharger according to claim 1, wherein:
the liquid-agent flow path includes a plurality of liquid-agent flow paths configured to supply the liquid agent respectively to the gas/liquid contact chambers, and
the gas flow path includes a plurality of gas flow paths, each configured to supply the gas respectively to the gas/liquid contact chambers.

11. A foam discharger comprising:
a mixing portion configured to mix a liquid agent and a gas to foam the liquid agent into a foamed liquid agent; and
a discharge opening configured to discharge the foamed liquid agent, wherein:
the mixing portion includes
gas/liquid contact chambers, each configured to make the liquid agent and the gas contact one another,
a liquid-agent flow path configured to supply the liquid agent to the gas/liquid contact chambers,
a gas flow path configured to supply the gas to the gas/liquid contact chambers, and
foam flow paths, each configured to supply the foamed liquid agent respectively from the gas/liquid contact chambers toward the discharge opening; and
at a location where the gas flow path and one of the gas/liquid contact chambers intersect with one another, the gas flow path extends on a first plane that intersects with a direction in which one of the foam flows path extends.

12. The foam discharger according to claim 1, wherein an angle formed between the first plane and a second plane intersecting perpendicularly with the direction in which the one of the foam flow paths extends is from −45° to 60° .

13. The foam discharger according to claim 12, wherein, at a location where the liquid-agent flow path and the one of the gas/liquid contact chambers intersect with one another, the liquid-agent flow path extends on the second plane.

14. The foam discharger according to claim 1, wherein:
the mixing portion includes two said liquid-agent flow paths configured to supply the liquid agent to the one of the gas/liquid contact chambers; and
the two liquid-agent flow paths are provided opposing one another with the one of the gas/liquid contact chambers located therebetween.

15. The foam discharger according to claim 1, wherein a first opening where the gas flow path and the one of the gas/liquid contact chambers come into communication is provided opposing a wall surface with the one of the gas/liquid contact chambers located therebetween.

16. The foam discharger according to claim 15, wherein a second opening where the liquid-agent flow path and the one of the gas/liquid contact chambers come into communication is provided in a manner that an opening center axis of the second opening is located closer to the one of the foam flow paths than an opening center axis of the first opening.

17. The foam discharger according to claim 1, wherein the one of the foam flow paths is provided extending upward from the one of the gas/liquid contact chambers along an up-down direction of the foam discharger.

18. The foam discharger according to claim 17, wherein, in a planar view in which the one of the gas/liquid contact chambers is viewed from above, a direction in which the gas flow path extends at the location where the gas flow path and the one of the gas/liquid contact chambers intersect with one another intersects perpendicularly with a direction in which two said liquid-agent flow paths extend at a location where the two liquid-agent flow paths and the one of the gas/liquid contact chambers intersect with one another.

19. A foam-discharging container comprising:
a container body configured to be filled with a liquid agent;
the foam discharger according to claim 1, the foam discharger being configured to be attached to a neck portion of the container body; and
an operation portion configured to receive pressing operation by a user, and
the foamed liquid agent being discharged by pressing of the operation portion.

20. The foam-discharging container according to claim 19, further comprising:
a cap member configured to be attached to the neck portion; and
a head portion supported by the cap member, wherein:
the head portion is provided with the discharge opening and the operation portion; and
by pressing of the operation portion by the user, the head portion is pressed down and the foamed liquid agent is discharged.

* * * * *